US009683512B2

(12) United States Patent
Stickler et al.

(10) Patent No.: US 9,683,512 B2
(45) Date of Patent: Jun. 20, 2017

(54) PRESSURE DEVICE TO REDUCE TICKING NOISE DURING ENGINE IDLING

(71) Applicant: Ford Global Technologies, LLC, Dearborn, MI (US)

(72) Inventors: Mark L. Stickler, Novi, MI (US); Vince Paul Solferino, Dearborn, MI (US); Paul Zeng, Inkster, MI (US); Ross Dykstra Pursifull, Dearborn, MI (US); Robin Ivo Lawther, Chelmsford (GB); Patrick Brostrom, White Lake, MI (US); Jacob Jensen, Farmington Hills, MI (US); Christopher Woodring, Canton, MI (US); Joseph F. Basmaji, Waterford, MI (US); Mark Meinhart, South Lyon, MI (US); Gopichandra Surnilla, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 298 days.

(21) Appl. No.: 14/286,648

(22) Filed: May 23, 2014

(65) Prior Publication Data

US 2015/0337753 A1 Nov. 26, 2015

(51) Int. Cl.
*F02D 41/08* (2006.01)
*F02D 41/38* (2006.01)
(Continued)

(52) U.S. Cl.
CPC ..... *F02D 41/3845* (2013.01); *F02D 41/08* (2013.01); *F02M 57/02* (2013.01);
(Continued)

(58) Field of Classification Search
CPC .. F02M 69/54; F02M 21/0239; F02M 59/366; F02M 37/0029; F02M 63/005;
(Continued)

(56) References Cited

U.S. PATENT DOCUMENTS 5,257,606 A 11/1993 Willman et al.
6,024,064 A 2/2000 Kato et al.
(Continued)

FOREIGN PATENT DOCUMENTS

EP 2143916 A1 1/2010
EP 2431597 A1 3/2012
WO 2012059267 A1 5/2012

OTHER PUBLICATIONS

Pursifull, Ross D. et al., "Direct Injection Fuel Pump," U.S. Appl. No. 14/198,082, filed Mar. 5, 2014, 67 pages.
(Continued)

*Primary Examiner* — Hung Q Nguyen
*Assistant Examiner* — Xiao Mo
(74) *Attorney, Agent, or Firm* — James Dottavio; McCoy Russell LLP

(57) ABSTRACT

Systems and methods are provided for a high-pressure fuel pump to mitigate audible ticking noise associated with opening and closing of a digital inlet valve of the high-pressure pump. To reduce the ticking noise associated with the high-pressure pump when the engine is idling, a solution is needed that is simple and does not involve retrofitting the fuel system with noise, vibration, and harshness countermeasures to mask the noise. Pressure devices and associated operation methods are provided that involve adding a combination of several check valves, an accumulator, and a flow control valve with weep channels to allow the digital inlet valve to be deactivated during engine idling as defined by a threshold engine speed.

20 Claims, 12 Drawing Sheets

(51) Int. Cl.

| | |
|---|---|
| ***F02M 57/02*** | (2006.01) |
| ***F02M 63/02*** | (2006.01) |
| ***F02M 59/46*** | (2006.01) |
| ***F02M 63/00*** | (2006.01) |
| ***F02M 59/36*** | (2006.01) |
| *F02M 59/10* | (2006.01) |

(52) U.S. Cl.

CPC ..... *F02M 59/368* (2013.01); *F02M 59/46* (2013.01); *F02M 63/005* (2013.01); *F02M 63/024* (2013.01); *F02M 63/0245* (2013.01); *F02D 2200/101* (2013.01); *F02D 2250/31* (2013.01); *F02M 59/102* (2013.01); *F02M 59/464* (2013.01); *F02M 2200/09* (2013.01); *F02M 2200/315* (2013.01)

(58) Field of Classification Search

CPC ..... F02M 63/024; F02M 59/368; F02M 63/0245; F02M 57/02; F02M 59/46; F02M 59/102; F02M 2200/315; F02M 59/464; F02M 2200/09; F02D 41/08; F02D 41/3845; F02D 2200/101; F02D 2250/31

See application file for complete search history.

(56) References Cited

U.S. PATENT DOCUMENTS

| | | | | |
|---|---|---|---|---|
| 6,138,638 | A | 10/2000 | Morikawa | |
| 6,142,747 | A | 11/2000 | Rosenau et al. | |
| 6,964,262 | B2 | 11/2005 | Hayakawa | |
| 7,216,627 | B2 | 5/2007 | Ito et al. | |
| 7,463,967 | B2 | 12/2008 | Ancimer et al. | |
| 7,536,997 | B2 * | 5/2009 | Koehler | F02M 59/102 123/495 |
| 8,091,530 | B2 | 1/2012 | Surnilla et al. | |
| 8,245,694 | B2 | 8/2012 | Kuhnke et al. | |
| 8,590,510 | B2 | 11/2013 | Surnilla et al. | |
| 2002/0170539 | A1 | 11/2002 | Rembold et al. | |
| 2009/0068041 | A1 * | 3/2009 | Beardmore | F02M 55/04 417/540 |
| 2010/0101538 | A1 * | 4/2010 | Beardmore | F02M 59/102 123/495 |
| 2011/0011369 | A1 | 1/2011 | Jaasma et al. | |
| 2012/0048242 | A1 | 3/2012 | Surnilla et al. | |
| 2012/0167859 | A1 | 7/2012 | Basmaji et al. | |
| 2012/0240669 | A1 * | 9/2012 | Nishigaki | F02D 41/221 73/114.45 |
| 2013/0125867 | A1 | 5/2013 | Krug | |
| 2013/0233284 | A1 | 9/2013 | Thaysen et al. | |
| 2016/0153385 | A1 * | 6/2016 | Pursifull | F02D 41/3845 123/299 |

OTHER PUBLICATIONS

Pursifull, Ross D. et al., "Direct Injection Fuel Pump," U.S. Appl. No. 13/830,022, filed Mar. 14, 2013, 50 pages.

Brostrom, Patrick et al., "Engine Fuel Pump and Method for Operation Thereof," U.S. Appl. No. 13/950,181, filed Jul. 24, 2013, 34 pages.

"Flow Controls for Plastic," Lee Company Product Catalog, pp. 116-117, The Lee Company, Westbrook, CT, 1 page.

* cited by examiner

PRESSURE DEVICE TO REDUCE TICKING NOISE DURING ENGINE IDLING

FIELD

The present application relates generally to a fuel delivery system for reducing ticking noise of a high-pressure fuel pump during low-speed operation of an idling engine.

SUMMARY/BACKGROUND

Fuel pumps are used in engines of vehicles to pressurize fuel in a fuel delivery system. Some fuel delivery systems are designed for high-pressure fuel delivery for direct injection systems, wherein fuel is injected into one or more cylinders of the engine. Other fuel delivery systems are designed for port injection, wherein fuel is injected into a component of an intake system and mixed with air to be delivered to the cylinders via one or more intake valves. Digital inlet valves (DIV) are often utilized to regulate fuel flow into a compression chamber of the fuel pump during fuel pump operation. Specifically, electronically-controlled solenoid valves of the DIV may be operated to selectively permit and inhibit fuel flow into the compression chamber from a fuel pump inlet. As a result, the pump compression chamber may receive fuel from the inlet during an intake stroke and deliver pressurized fuel to downstream components during a delivery stroke. The present disclosure focuses on high-pressure fuel pumps that pressurize fuel prior to entry into direct injectors of a direct injection system.

When the digital inlet valve is selectively energized with an electrical current to inhibit fuel flow between the pump compression chamber and the fuel pump inlet, ticking or other such noises may be produced by impact forces between components of the digital inlet valve. During vehicle motion when the engine is operated above a threshold speed, the ticking noise may be masked or covered by noise produced by the engine, which is perceived as normal. However, when the engine is operated below a threshold speed which may be characterized as engine idling, the engine may produce a lower volume of noise, thereby allowing the ticking noise of the digital inlet valve and fuel pump to be audible. The ticking noise may be perceived as abnormal by a vehicle operator. As such, there is a desire to reduce the volume of the ticking noise.

In one approach to mitigate ticking noise of the digital inlet valve, shown by Surnilla et al. in U.S. Pat. No. 8,091,530, electrical current supplied to the solenoid valve (digital inlet valve) according to pressure downstream of the fuel pump. This approach involves calibrating the pull-in current of the solenoid valve in a feedback loop to a smallest nominal value that is still large enough to close the solenoid valve. By adjusting the supply current, the closing force of the solenoid valve may be reduced so that the valve closes gently and ticking noise may be reduced or eliminated. In a related method, the pull-in current of the solenoid valve is adjusted during an idle condition and the method further includes initiating a holding current to hold the solenoid valve in the closed position in response to downstream fuel pressure.

However, the inventors herein have identified potential issues with the approach of U.S. Pat. No. 8,091,530. First, implementing the methods for adjusting current supplied to the solenoid valve (digital inlet valve) may involve consuming more of the processing power of a vehicle controller than may be necessary otherwise. Furthermore, the process of learning the current adjustments and storing the currents for later use may be prone to error which may result in erroneous digital inlet valve behavior and continued pump ticking noise. Also, determining the level of ticking noise produced by the digital inlet valve may be subjective since the level of audible noise may vary from person to person or whoever operates the vehicle. The methods provided in U.S. Pat. No. 8,091,530 may only decrease the amount of ticking noise produced by the digital inlet valve and may not entirely remove the noise.

Thus in one example, the above issues may be at least partially addressed by a method, comprising: during an engine idling condition, regulating high-pressure fuel pump pressure via a pressure device including a first and second check valve with opposite orientations without activating a digital inlet valve coupled to an inlet of the high-pressure fuel pump; and during a non-idling engine condition, adjusting activation of the digital inlet valve to regulate fuel pressure. In this way, rather than decreasing impact force associated with closing and opening of the digital inlet valve, the valve may remain deactivated throughout the delivery stroke of the high-pressure pump during engine idling. Maintaining the deactivated digital inlet valve in an open position and allowing the pressure device to provide the desired fuel pressure may reduce or eliminate ticking noise while not adversely affecting operation of the high-pressure fuel pump.

In another example, an accumulator may be included in the pressure device. The accumulator may store excess fuel pressure so as to keep a pressure relief valve in a closed position. Instead of flowing fuel backwards and upstream from the pressure device in what is known as fuel reflux, fuel may be inhibited from flowing backwards by the pressure device and the accumulator. Furthermore, since a default position of the digital inlet valve may be the open position, continuous current may not be provided to the digital inlet valve during engine idling, thereby reducing energy consumption. Since the pressure device is a mechanical device, it may be passively operated without connection to the vehicle controller. As such, instances of erroneous behavior of the pressure device may be lower than the instances of erroneous behavior of electronically-controlled systems. The pressure device may also be modified to include a single flow control valve with weep channels for reducing noise associated with hydraulic pulsations upstream of the high-pressure fuel pump.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
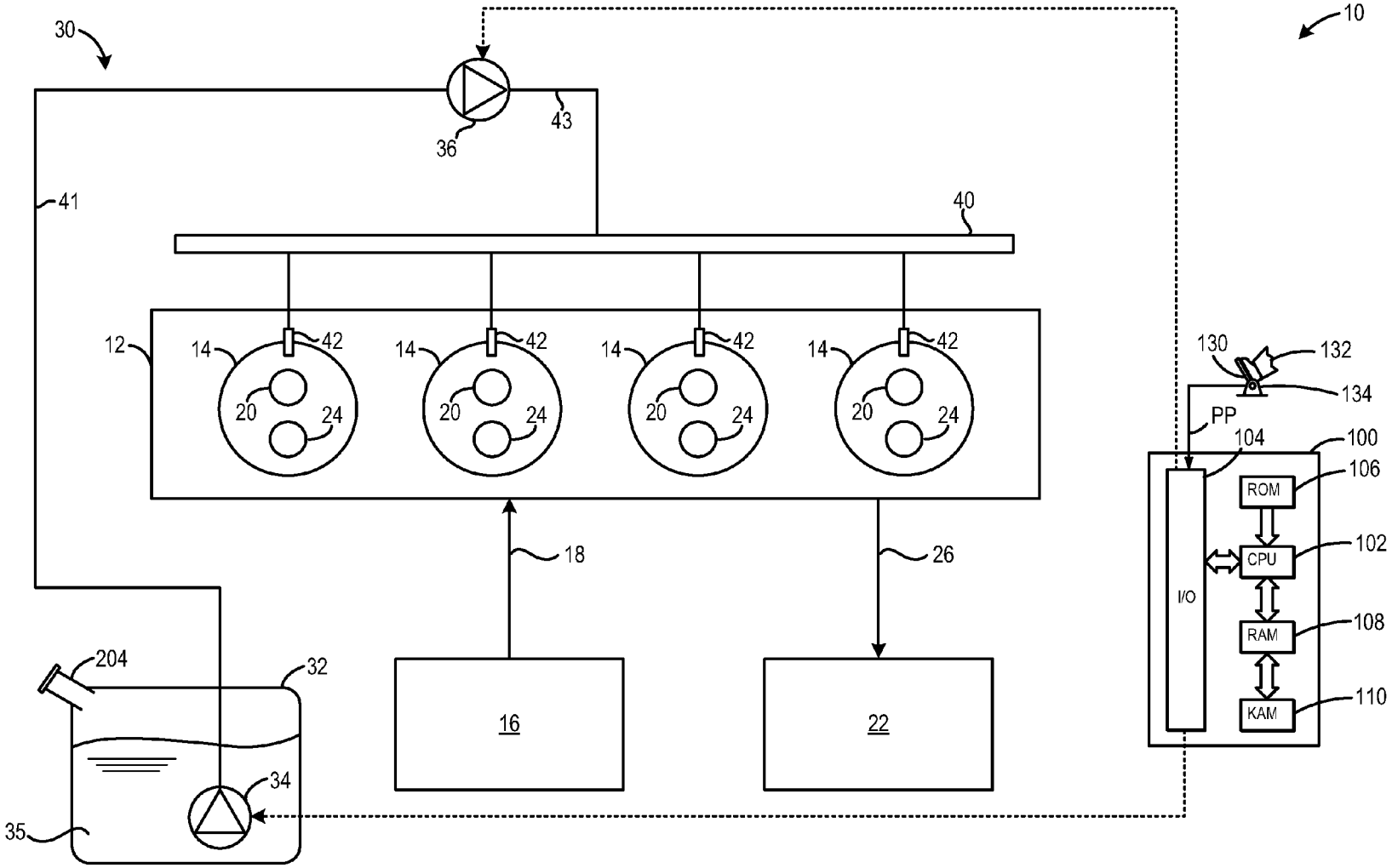
FIG. 1 shows a simplified schematic diagram of an engine system.
Figure 2:
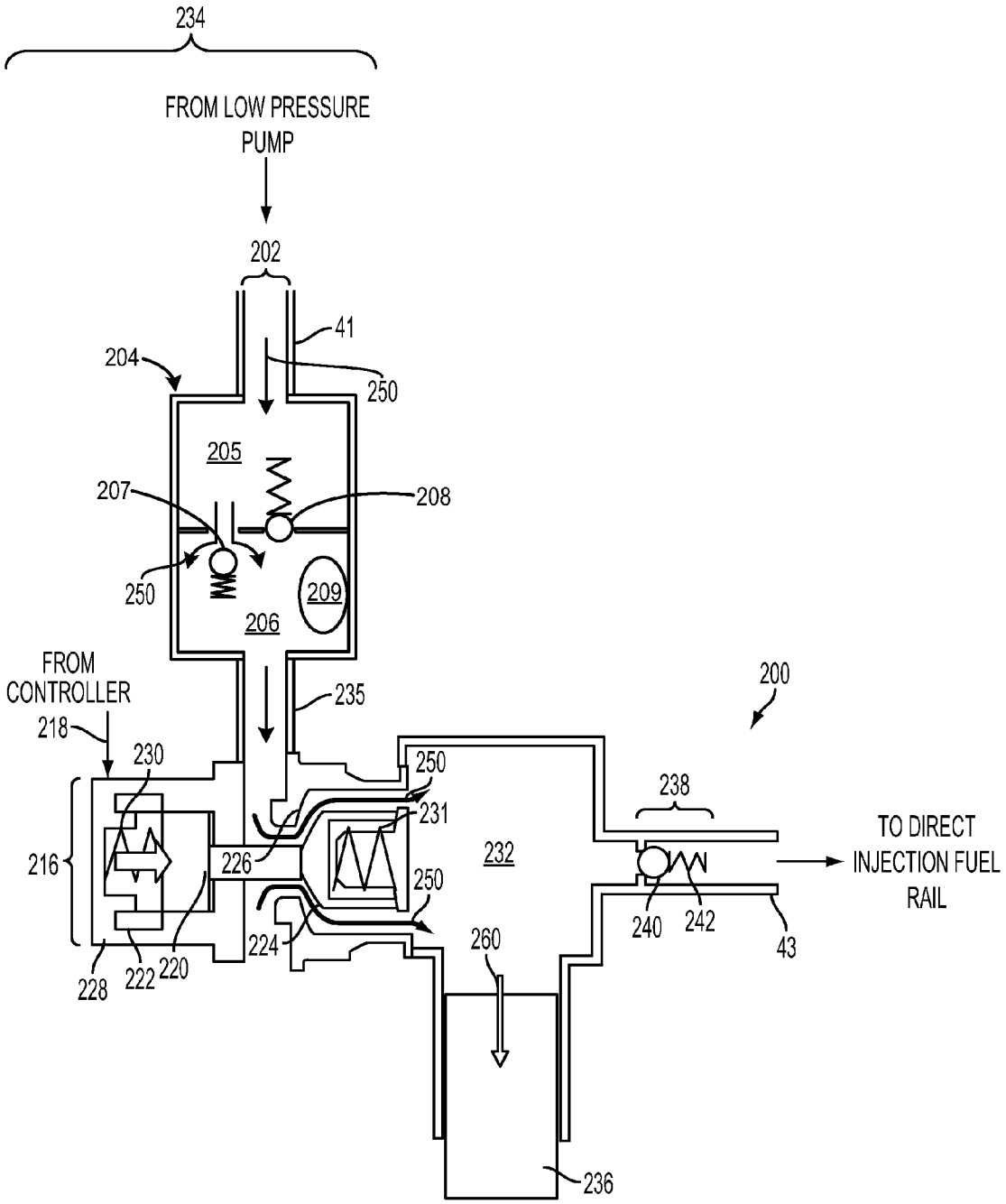
FIG. 2 shows a first example high-pressure fuel pump during an intake stroke.
Figure 3:
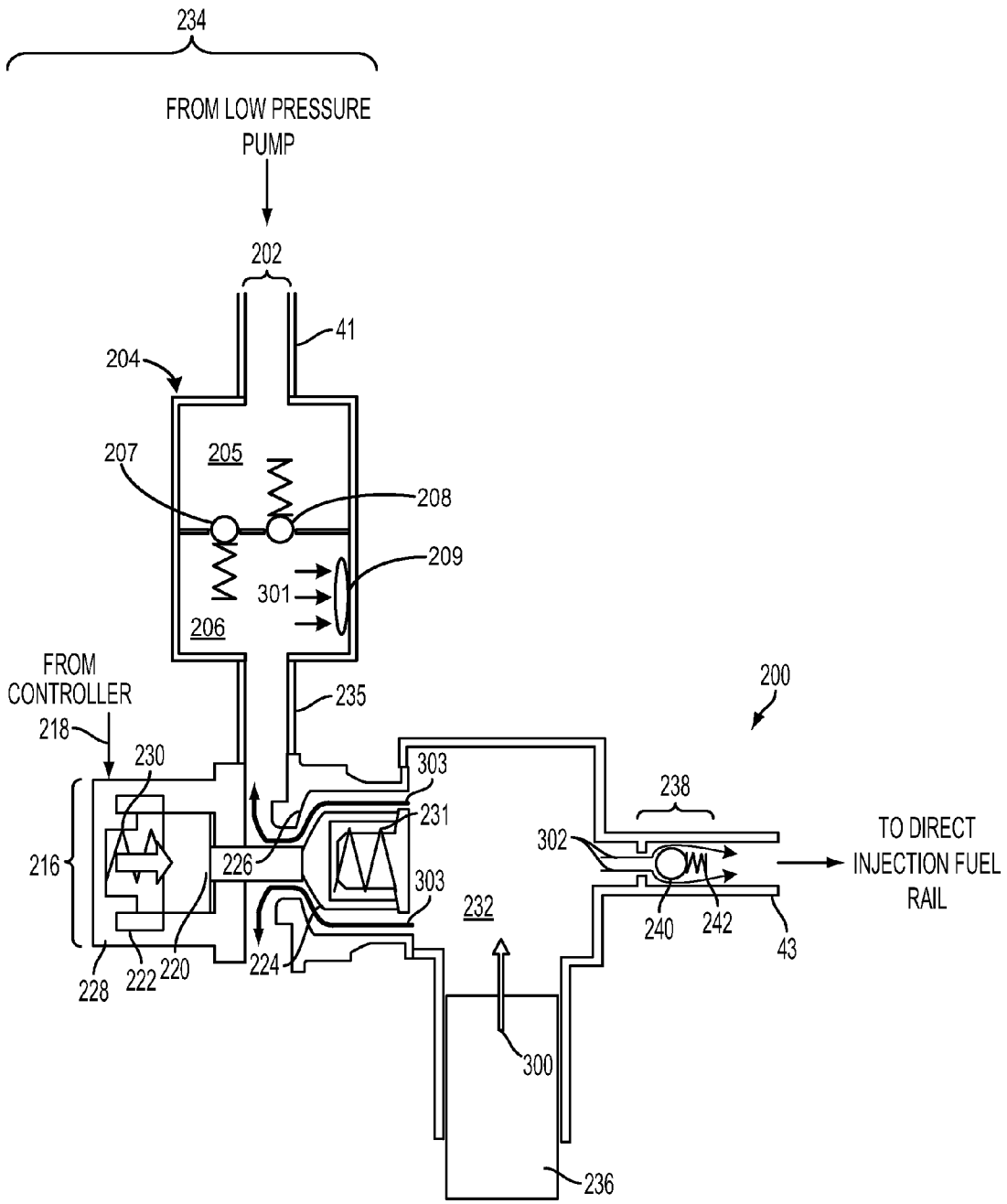
FIG. 3 shows the first example high-pressure fuel pump during a first delivery stroke at engine idle.
Figure 4:
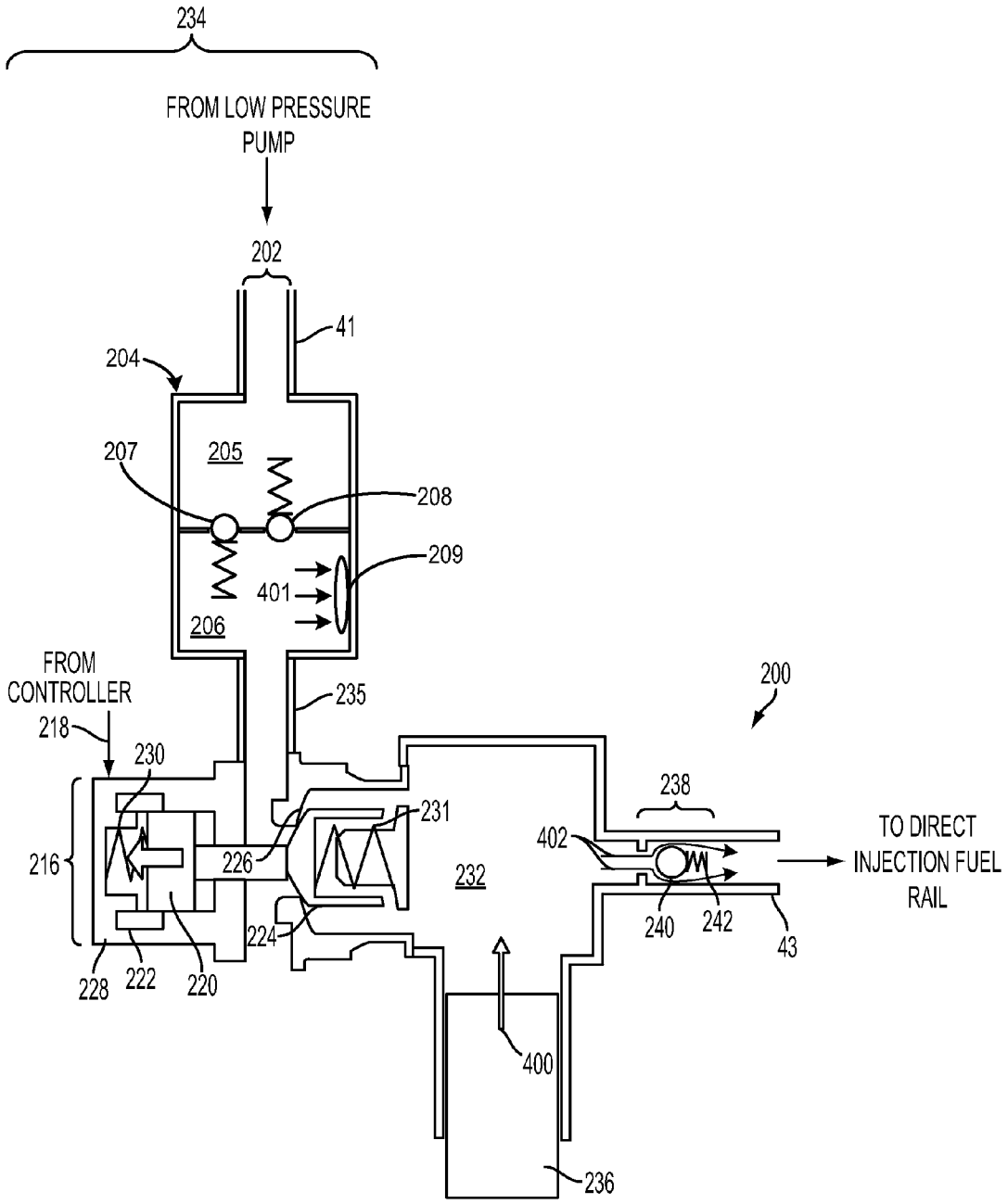
FIG. 4 shows the first example high-pressure fuel pump during a second delivery stroke at engine off-idle.
Figure 5:
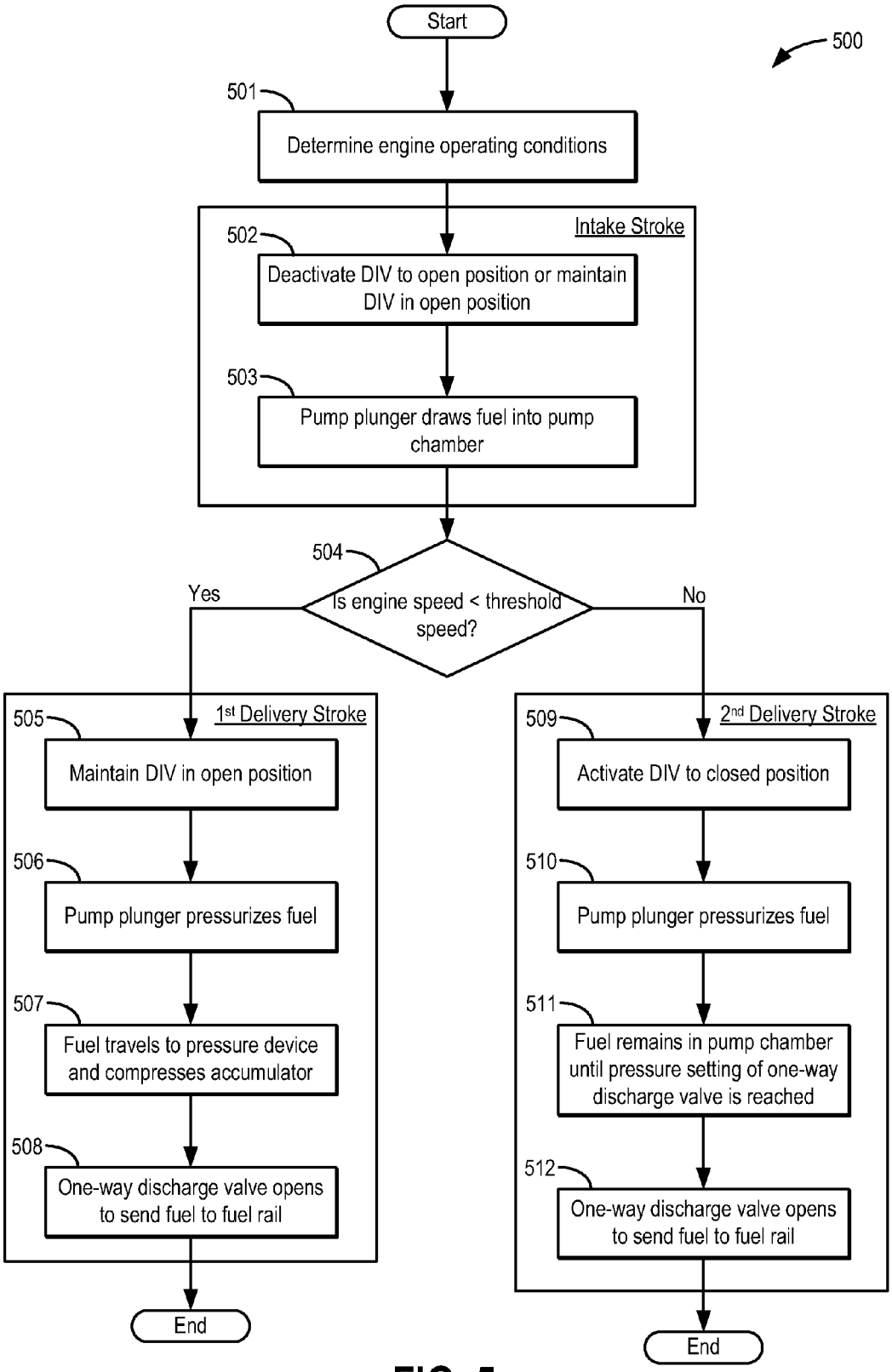
FIG. 5 shows a method for pressurizing fuel for a direct injection fuel system with the high-pressure fuel pump of FIGS. 2-4.
Figure 6A:
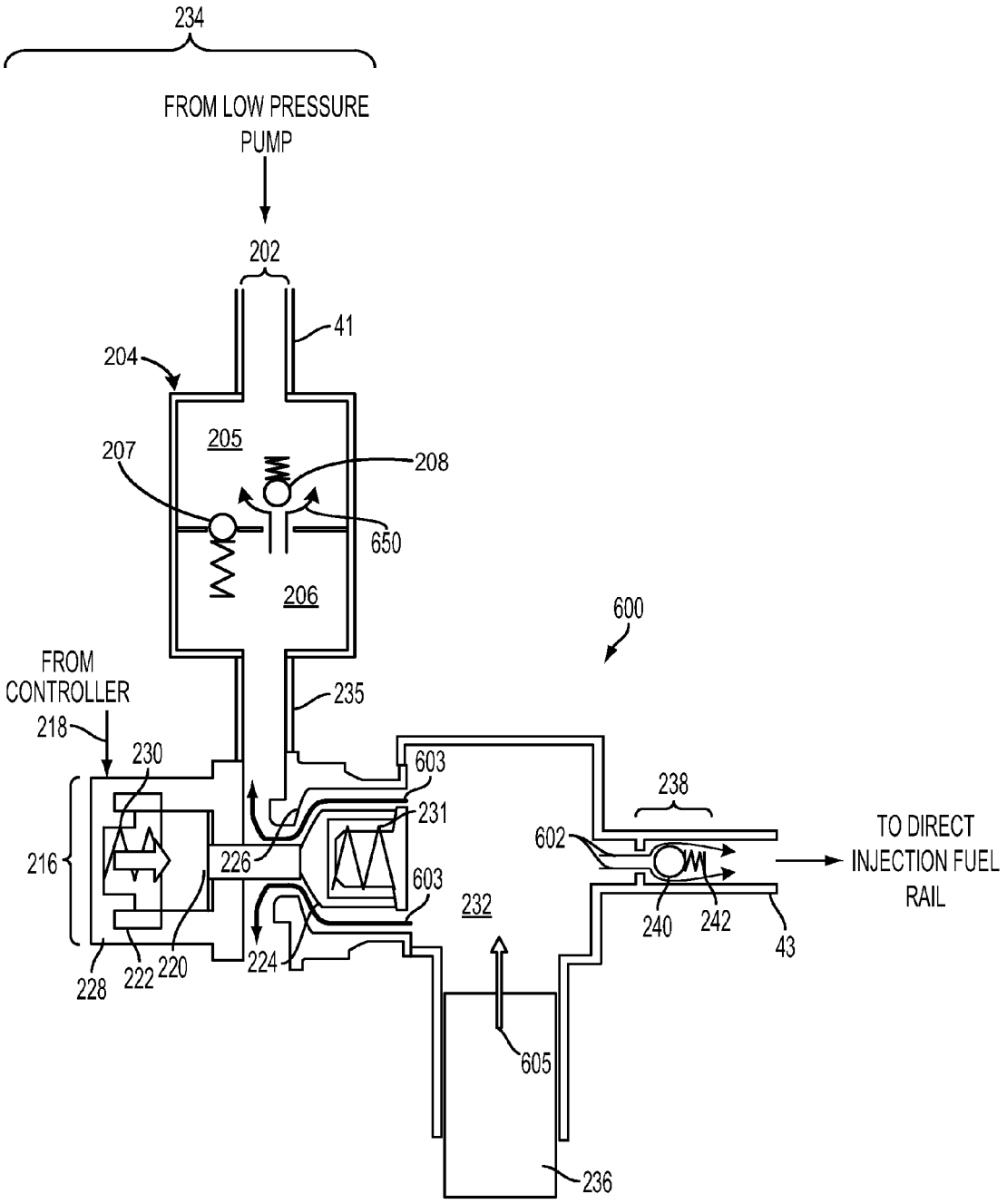
FIG. 6A shows an example high-pressure fuel pump during a delivery stroke with fuel reflux.
Figure 6B:
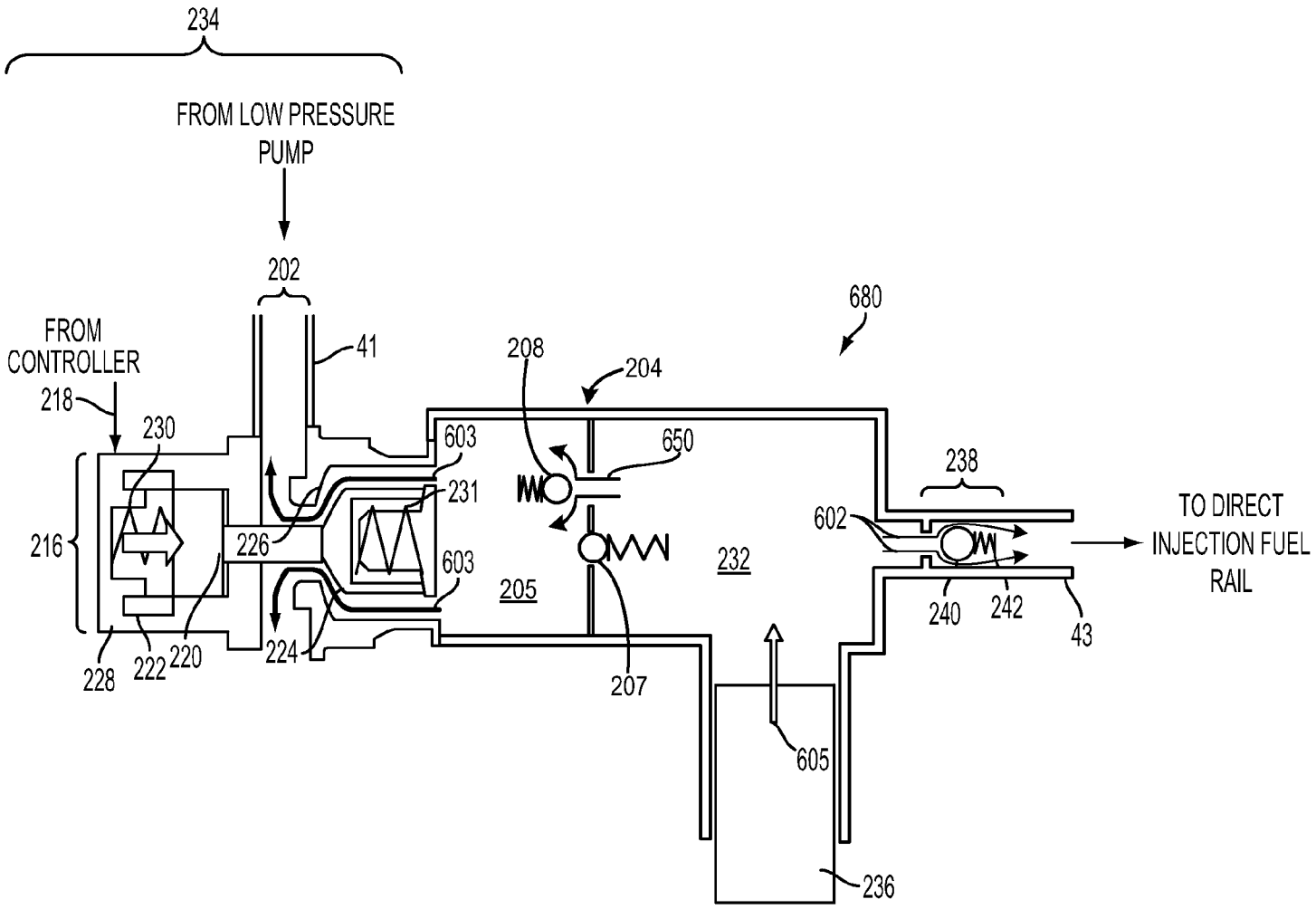
FIG. 6B shows an example high-pressure fuel pump with an integrated pressure device during a delivery stroke with fuel reflux.
Figure 7:
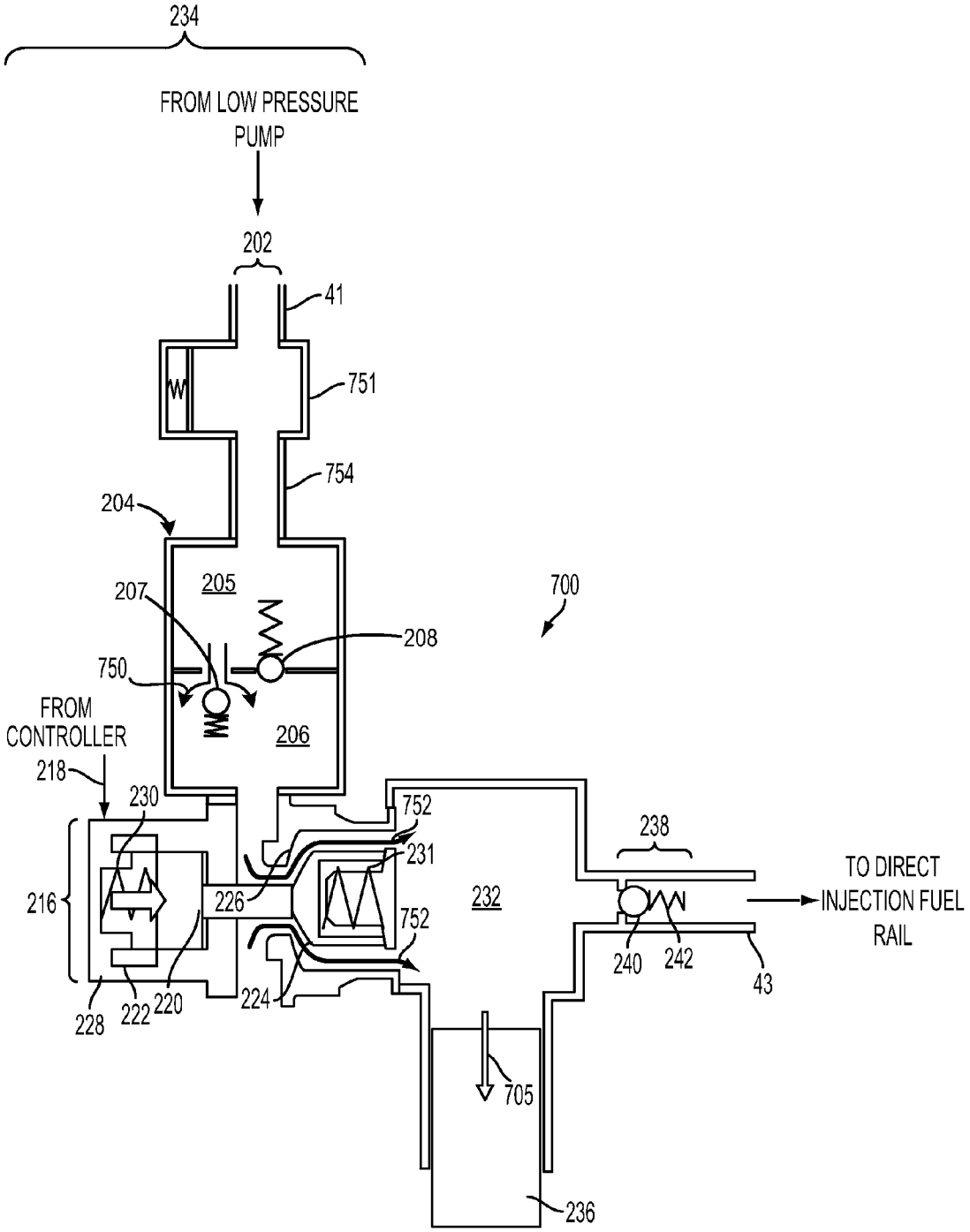
FIG. 7 shows an example high-pressure fuel pump with a pressure device sharing a housing with the high-pressure fuel pump during an intake stroke.
Figure 8:
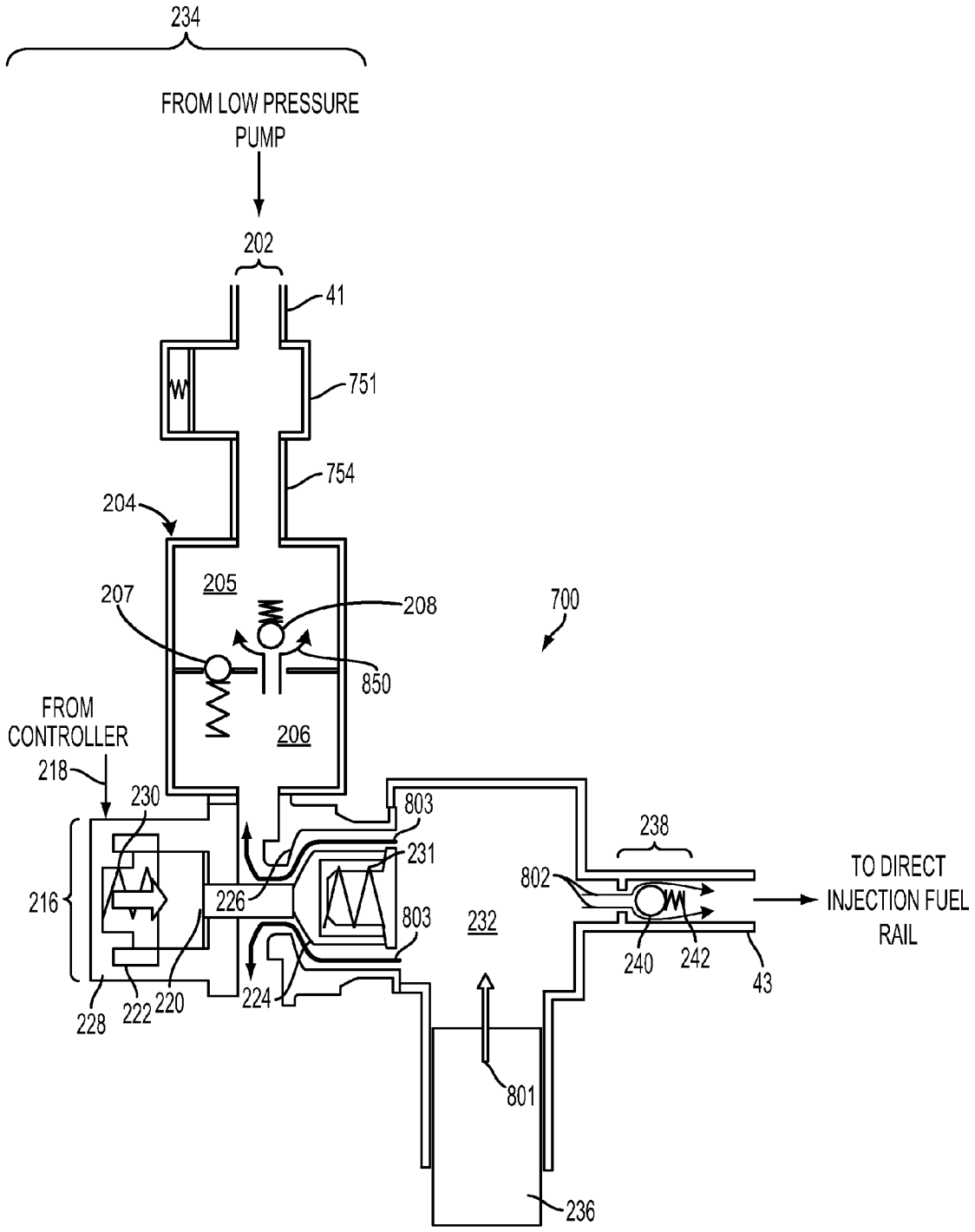
FIG. 8 shows the high-pressure fuel pump of FIG. 7 during a delivery stroke with fuel reflux.
Figure 9:
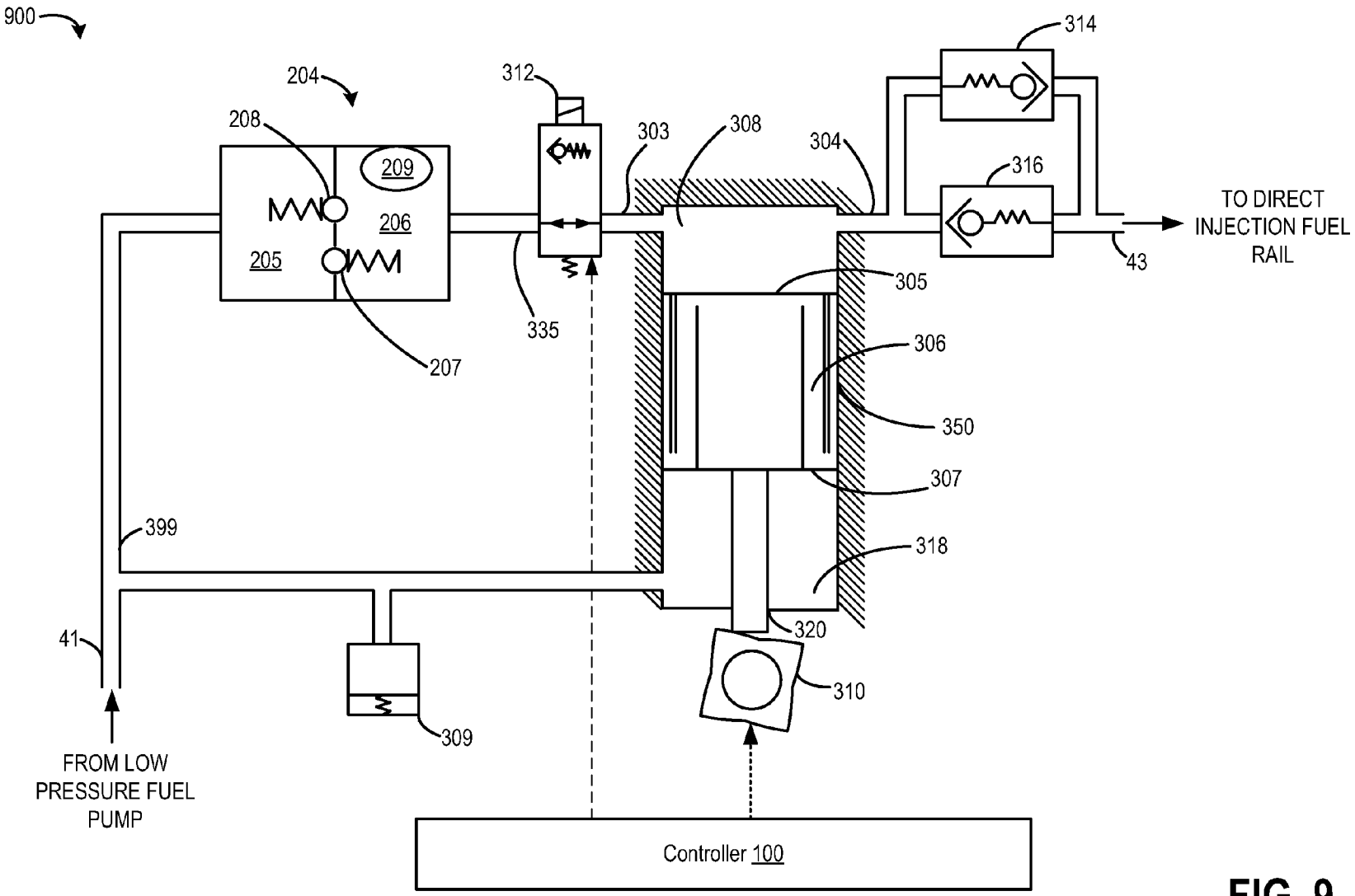
FIG. 9 shows an example high-pressure fuel pump with a simplified structure.
Figure 10A:
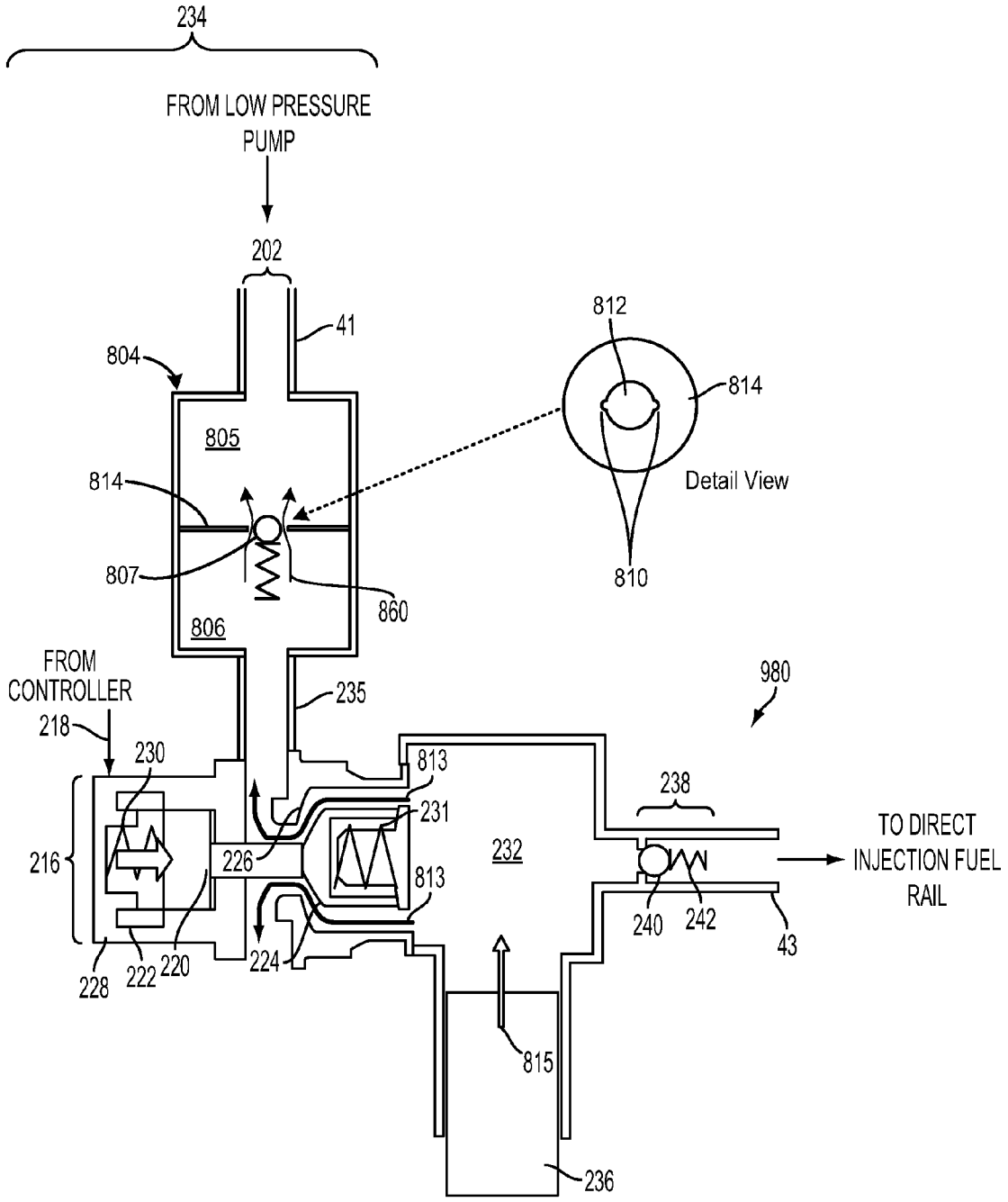
FIG. 10A shows an example high-pressure fuel pump with a fuel flow control valve during a delivery stroke with fuel reflux.
Figure 10B:
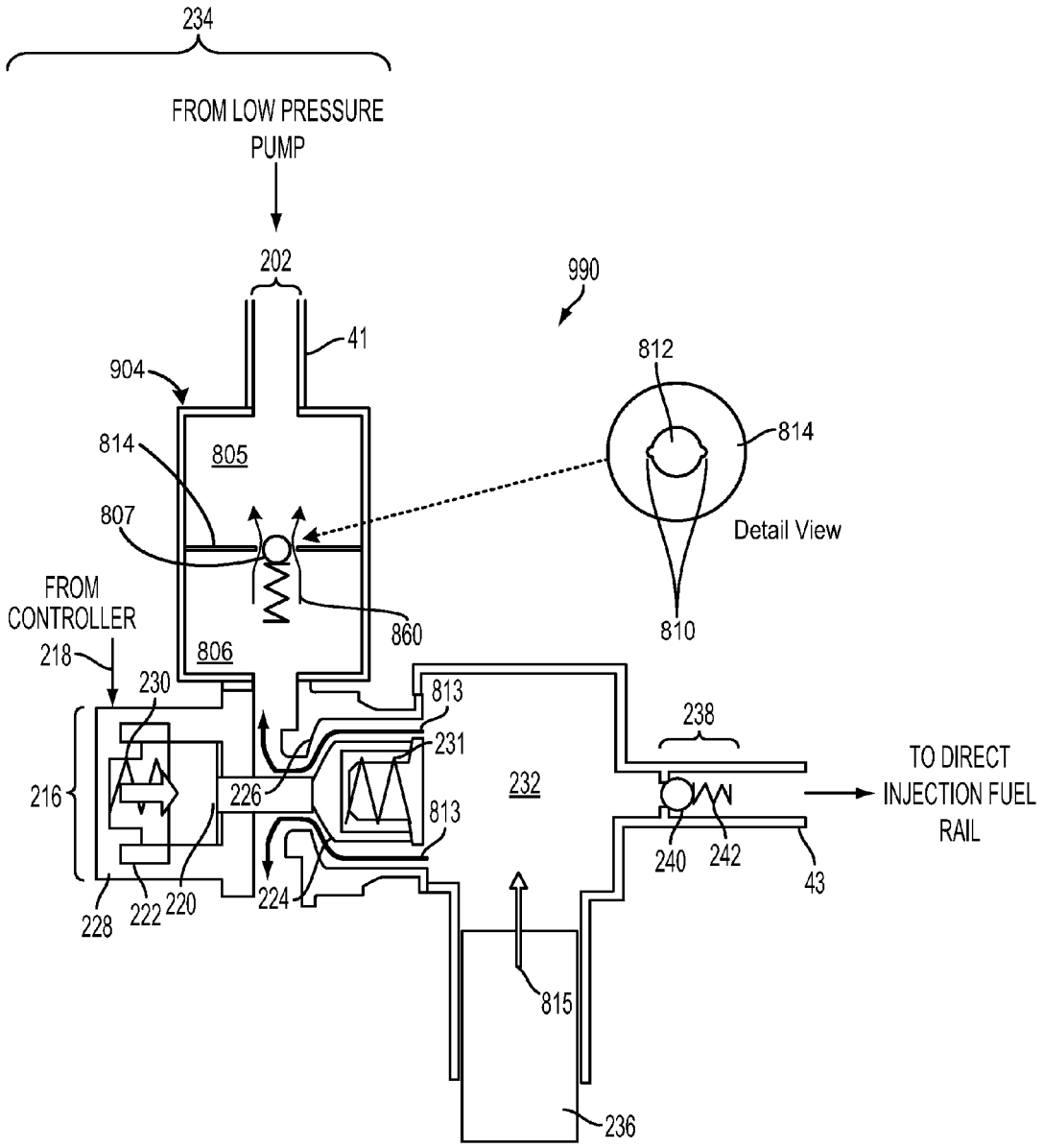
FIG. 10B shows an example high-pressure fuel pump with an integrated fuel flow control valve during a delivery stroke with fuel reflux.

The following detailed description provides information regarding pressure devices and high-pressure fuel pumps with several associated operation methods. A simplified schematic diagram of an engine system with an engine and fuel delivery system is shown in FIG. 1. A first example of a high-pressure fuel pump during an intake and two separate delivery strokes is shown in FIGS. 2-4. A method for operating the first example high-pressure fuel pump is depicted in FIG. 5, wherein several steps may be performed by a vehicle controller while other steps may initiate as a result of previous steps. FIG. 6A shows a second example of a high-pressure fuel pump, similar to the first example high-pressure fuel pump but with an accumulator removed. FIG. 6B shows a third example of a high-pressure fuel pump with a pressure device of FIG. 6A included inside the pump. FIGS. 7 and 8 shows another example of a high-pressure fuel pump with a pressure device attached to the housing of the pump. FIG. 9 shows an example high-pressure fuel pump in a simplified form to clearly see the structural relationships between various components and systems. Finally, FIGS. 10A and 10B show other example high-pressure fuel pumps with flow control valves including weep channels.

Regarding terminology used throughout this detailed description, a high-pressure pump, or direct injection pump, may be abbreviated as a DI or HP pump. Similarly, a low-pressure pump, or lift pump, may be abbreviated as a LP pump. Also, the digital inlet valve (DIV) or digitally-controlled inlet valve may be referred to as a magnetic solenoid valve (MSV) or a solenoid-activated inlet check valve. The DIV receives an electrical current from an external source to energize one or more components of the DIV to create a seal that effectively prevents fuel or other fluid from flowing upstream of the DIV, similar to the function of a check valve.

FIG. 1 shows a simplified schematic diagram of an engine system 10 including an engine 12. The engine 12 is configured to implement combustion operation. For example, a four stroke combustion cycle may be implemented including an intake stroke, a compression stroke, a power stroke, and an exhaust stroke. However, other types of combustion cycles may be utilized in other examples. In this way, motive power may be generated in the engine system 10 to provide to the wheels of a vehicle. It will be appreciated that the engine may be coupled to a transmission for transferring rotation power generated in the engine 12 to wheels in the vehicle.

The engine 12 includes at least one cylinder 14. In the depicted example of FIG. 1, four cylinders 14 are shown in an in-line configuration. However, engines having different cylinder configurations have been contemplated. For instance, additional cylinders may be arranged in an inline configuration where the cylinders are positioned in a straight line, a horizontally opposed configuration, a V-configuration where multiple banks of cylinders are provided, etc.

An intake system 16 is configured to provide air to the cylinders 14. The intake system 16 may include a variety of components for achieving the aforementioned functionality such as a throttle, an intake manifold, compressor, intake conduits, etc. As shown, the intake system 16 is in fluidic communication with the cylinders 14, denoted via arrow 18. It will be appreciated that one or more conduits, passages, etc., may provide the fluidic communication denoted via arrow 18. Each cylinder 14 may be equipped with an intake valve 20, which may be a common poppet valve. Intake valves 20 may provide the fluidic communication between the intake system 16 and the cylinders 14. The intake valve 20 may be cyclically opened and closed to provide gaseous substances to implement combustion operation in the engine.

Furthermore, the engine 12 further includes an exhaust system 22 configured to receive exhaust gas from the cylinders 14. The exhaust system may include manifolds, conduits, passages, emission control devices (e.g., catalysts, filters, etc.), mufflers, etc. Each cylinder 14 may be equipped with an exhaust valve 24, which may be a common poppet valve. Exhaust valves 24 coupled to the cylinders 14 are included in the exhaust system 22. The exhaust valves 24 may be configured to cyclically open and close during combustion operation. The exhaust system 22 is in fluidic communication with the cylinders 14, denoted via arrow 26. Specifically, arrow 26 may indicate exhaust passages, conduits, etc., providing fluidic communication between the exhaust system 22, cylinders 14, and the exhaust valves 24. Intake valves 20 and exhaust valves 24 may operate to enable combustion within cylinders 14. In other embodiments, each cylinder 14 may include more than one intake valve 20 and exhaust valve 24.

The engine system 10 further includes a fuel delivery system 30. The fuel delivery system 30 may include a fuel tank 32 and a first fuel pump 34 or low-pressure fuel pump (i.e., lift pump) configured to flow fuel to downstream components via low-pressure fuel line 41. The fuel tank 32 may store a liquid fuel 35 (e.g., gasoline, diesel, ethanol, etc.). The fuel delivery system 30 further includes a second fuel pump 36 or high-pressure fuel pump (i.e., direct injection pump) configured to pressurize fuel for injection into cylinders 14. The second fuel pump 36 is in fluidic communication with a fuel rail 40 and a number of fuel injectors 42 coupled to cylinders 14. It will be appreciated that in other examples the fuel delivery system 30 may include a single fuel pump or additional fuel pumps along with additional fuel tanks for multi-fuel systems. The fuel rail 40 is positioned downstream of the second fuel pump 36 and therefore may be in fluidic communication with the second fuel pump via high-pressure fuel line 43. Fuel lines 41 and 43 provide the fluidic communication between the fuel tank 32, the low-pressure fuel pump 34, the high-pressure fuel pump 36, and the fuel rail 40. The one or more fuel injectors 42 may be positioned downstream of the fuel rail 40 and therefore may be in fluidic communication with the fuel rail 40. The fuel injectors 42 are shown directly coupled to the cylinders 14 providing what is known as direct injection. Additionally or alternatively, one or more port fuel injectors may be included in the fuel delivery system 30 configured to provide fuel to an intake conduit upstream of the intake valves 20. For example, port fuel injection may be provided in a component of intake system 16, thereby allowing intake valves 20 to provide an air and fuel mixture to cylinders 14.

A controller 100 may be included in the vehicle. The controller 100 may be configured to receive signals from sensors in the vehicle as well as send command signals to components such as the first fuel pump 34 and/or the second fuel pump 36, as directed by the dotted arrows in FIG. 1. Although not shown in the simplified diagram of FIG. 1, controller 100 may include various additional connections to different engine components such as fuel injectors 42.

Various components in the engine system 10 may be controlled at least partially by a control system including the controller 100 and by input from a vehicle operator 132 via an input device 130. In this example, input device 130 includes an accelerator pedal and a pedal position sensor 134 for generating a proportional pedal position signal PP. The controller 100 is shown in FIG. 1 as a microcomputer, including processor 102 (e.g., microprocessor unit), input/output ports 104, an electronic storage medium for executable programs and calibration values shown as read only memory 106 (e.g., read only memory chip) in this particular example, random access memory 108, keep alive memory 110, and a data bus. Storage medium read-only memory 106 can be programmed with computer readable data representing instructions executable by processor 102 for performing the methods described below as well as other variants that are anticipated but not specifically listed. As shown, the fuel pumps (34 and 36) may receive control signals from the controller 100 to facilitate fuel delivery control, discussed in greater detail herein.

FIG. 1 is understood to be exemplary in nature and to provide a general understanding of one possible engine system 10. It is noted that an ignition system is excluded from FIG. 1, that is, the spark plugs or other devices that provide ignition inside cylinders 14. Modifications may be made to engine system 10 while still pertaining to the scope of the present disclosure. For example, a turbocharger may be included in engine system 10 by providing a compressor in intake system 16 and a turbine in exhaust system 22, where the turbine and compressor may be connected by a common shaft. In another example, a second fuel tank may be provided in addition to fuel tank 32, wherein the second fuel tank contains a different type of fuel. Furthermore, additional fuel lines may be included to provide selective mixing or separation of the two different fuels. It can be seen that other configurations of engine system 10 are possible.

Many high-pressure fuel pumps may generate a ticking noise that contributes to NVH of the engine. Although the noise may not cause physical damage to the vehicle or adversely affect engine operation, the noise may alarm the vehicle operator to wrongly assume a vehicle malfunction has occurred. Furthermore, many resources and time have been dedicated to reduce the noise associated with the high-pressure pump. The ticking noise may be particularly noticeable when the engine is operating in an idling condition, or when the engine is running below a threshold speed. When the engine is idling such as when the vehicle is not in motion, the ticking noise may be noticeable by the vehicle operator over the noise generated by the engine. When the engine is running at speeds above the threshold speed, the engine noise may mask or otherwise obscure the ticking noise of the high-pressure pump.

In this context, the definition for engine idling includes operating the engine below a threshold speed, while non-idling (off-idling) includes operating the engine above a threshold speed. The specific RPM defining the threshold speed may depend on the particular engine system. For example, some engine systems may be naturally louder, thereby allowing the threshold speed to be lower than the threshold speed of a naturally quieter engine system. Commonly, engine idling may refer to running the engine in a stationary vehicle, wherein the engine is being primarily used for electrical supply, cabin environment conditioning, and engine readiness. However, in the context of the present disclosure, engine idling refers to operating the engine below a threshold speed. The present definition of engine idling may at least partially overlap with the common definition. However, if the vehicle is moving slowly and the pump ticking noise is still audible, then the present idling definition may include the corresponding range of engine operation where the vehicle is slowly moving. In this way, the threshold speed defining idling and non-idling is based on when ticking noise of the HP pump is audible by the vehicle operator.

As mentioned previously, the digital inlet valve (DIV) or solenoid-activated inlet check valve may be an electronically-controlled valve configured to selectively allow fuel to enter (or exit) a compression chamber of the high-pressure fuel pump. Research and test data has shown that the ticking noise of the high-pressure pump may result at least partially from closing and opening of the DIV valve. In particular, an armature-to-limiter impact may occur when the DIV closes and a suction valve-to-seat impact may occur when the DIV opens. The impact energy generated by the impacts may excite the high-pressure pump along with transmitting the energy to the cylinder head if the pump is attached to the cylinder head. Furthermore, the impact energy may travel to other vehicle components such as the engine block, oil pan, cam covers, and intake/exhaust manifolds. As such, the ticking noise may transmit throughout the engine and be noticeably audible when normal engine noise is reduced during idling.

A common way to reduce the NVH associated with the high-pressure pump may be to provide dampening and other system modifications to mask the ticking noise. The inventors herein have recognized that reducing the ticking noise in the DIV may be more favorable then attempting to mask the generated ticking noise. As such, several modified high-pressure fuel pumps with digital inlet valves are provided with attached pressure devices to aid in reducing the ticking noise produced by the DIV. Furthermore, methods for operating the modified high-pressure fuel pumps are provided that may provide the necessary fuel pressure to the fuel rail while reducing the need for spending resources on NVH mitigation solutions.

FIGS. 2-4 show a first example high-pressure fuel pump 200 in different modes of operation. It will be appreciated that the fuel pump 200 shown in FIGS. 2-4 may be similar to the fuel pump 36 shown in FIG. 1 and therefore may be included in the fuel delivery system 30, shown in FIG. 1. The fuel pump 200 shown in FIGS. 2-4 includes an inlet 202 in fluidic communication with upstream components such as a fuel tank and/or a lower pressure fuel pump. If HP pump 200 were used as pump 36 in FIG. 1, then low-pressure fuel line 41 may be included in inlet 202 and fuel entering inlet 202 may be pumped towards HP pump 200 by low-pressure pump 34.

The fuel pump 200 includes a pressure device 204 in fluidic communication (e.g., direct fluidic communication) with the inlet 202. The pressure device 204 may be configured to selectively permit and inhibit fuel flow therethrough according to pressure settings of check valves 207 and 208 and fuel pressure present upstream and downstream of device 204, as explained later in further detail. In particular, check valve 207 may be an inlet check valve while check valve 208 may be a pressure relief valve, where valves 207 and 208 have opposite orientations as seen in FIG. 1. Furthermore, pressure device 204 includes an inlet chamber 205 coupled to inlet 202 and an outlet chamber 206 coupled to inlet line 235. Inlet line 235 provides fluidic communication between outlet chamber 206 and downstream components.

Valve 207 may substantially prevent backward fuel flow while allowing fuel to enter outlet chamber 206 upon fuel in inlet chamber 205 reaching the pressure setting of valve 207. Oppositely, valve 208 may substantially prevent forward fuel flow while allowing fuel to enter inlet chamber 205 upon fuel in outlet chamber 206 reaching the pressure setting of valve 208. In the present example, pressure device 204 may be passively controlled, that is, not electronically controlled, via hydraulic pressure of the fuel in pump 200 and from inlet 202. Valves 207 and 208 operate based on the valve pressure settings and fuel pressure differential across the valves, that is, the pressure difference between chambers 205 and 206. Fuel located in outlet chamber 206 may flow freely through line 235 and into a digital inlet valve (DIV) 216.

The outlet chamber 206 may include an accumulator 209, which may be a flexible, generally spherical diaphragm or round accumulator that can be compressed by fuel with a pressure greater than the flexible strength of the accumulator. In this way, when fuel pressure is large enough, the accumulator 209 may be compressed and reduced in size, thereby storing pressure. Upon a certain decrease in fuel pressure, the accumulator 209 may expand to its original, undeformed round shape, thereby transferring the stored pressure back to the fuel. In other embodiments, accumulator 209 may comprise a rigid housing with an expandable interior that can change volume based on a retaining spring. Other accumulator configurations are possible.

The fuel pump 200 further includes digital inlet valve (DIV) 216 which may be coupled to an inlet of the HP pump 200. The DIV 216 may be in electronic communication with a controller indicated via arrow 218, such as controller 100 shown in FIG. 1. Therefore, the configuration of the DIV 216 may be adjusted via a controller and is discussed in greater detail herein. The DIV 216 may include a core tube 220 at least partially enclosed via a coil 222. A sealing element 224 is coupled (e.g., directly coupled) to the core tube 220. The sealing element 224 may be configured to seat on a DIV sealing surface 226 when the DIV is in a closed configuration. Likewise, the sealing element 224 is spaced away from the sealing surface 226 when the DIV is in an open configuration. The DIV 216 also includes a housing 228 at least partially enclosing the coil 222 and the core tube 220.

The core tube 220 and the sealing element 224 move in an axial direction responsive to controller input signal. The DIV further includes a first spring 230 and a second spring 231. The neutral position of the first spring 230 and the second spring 231 may urge the core tube 220 and the sealing element in an open position, permitting fuel to flow through the DIV 216 to a pump compression chamber 232. On the other hand, in a closed configuration the coil 222 in the DIV 216 may be energized to urge the sealing element 224 towards the sealing surface 226. Therefore, in a closed position the sealing element 224 seats and seals in the sealing surface 226. As such, when the DIV 216 is activated or energized, fuel or other hydraulic fluid may be substantially prevented from flowing through DIV 216 in the backward direction. When DIV 216 is activated, the valve is in the closed position. Conversely, when the DIV 216 is deactivated or de-energized, fuel or other hydraulic fluid may flow through the DIV 216 in the forward or backward directions. When DIV 216 is deactivated, the valve is in the open position. In this case, the forward or downstream direction may refer to the general direction of fuel flowing from the low-pressure fuel pump to the direct injection fuel rail, as shown by the arrows in FIG. 2. Oppositely, the backward or upstream direction may refer to the general direction of fuel flowing from the direct injection fuel rail to the low-pressure fuel pump, or towards the pressure device 204.

As shown in FIG. 2, the pressure device 204 and the DIV 216 are shown positioned on an inlet side 234 of the fuel pump 200. Specifically, the DIV 216 is positioned downstream of the pressure device 204, that is, closer to the direct injection fuel rail. However, other configurations are possible. For example, the DIV 216 may be positioned upstream of the pressure device 204. As depicted, the DIV 216 and the pressure device 204 are in series fluidic communication. Conversely, in some examples the DIV 216 and the pressure device 204 may be in parallel fluidic communication. Furthermore, as explained with regard to different HP pump configurations in other figures, pressure device 204 and DIV 216 may be separate or part of the HP pump.

The fuel pump 200 also includes a pump chamber or compression chamber 232 positioned downstream of the DIV 216 and the pressure device 204. The pump chamber 232 is therefore in fluidic communication with the aforementioned valves and components of pressure device 204 and DIV 216. A plunger or piston 236 may also be included in the fuel pump 200 and is configured to increase and decrease the volume in the pump chamber 232. The plunger 236 may be mechanically coupled to a crankshaft, cams, etc. Thus, the plunger 236 may be cam driven, in one example. Therefore, it will be appreciated that the plunger 236 may move in an upward and downward motion. The plunger 236 may be mechanically driven along a linear direction by an electric motor, driven by a driving cam actuated by crankshaft motion, etc. When the driving cam is driven by crankshaft motion of an engine, such as engine 12 of FIG. 1, the linear speed of plunger 236 may be proportional to the rotational speed of the engine. The plunger 236 enables the pump chamber 232 to draw in fuel from the fuel tank and release fuel to downstream components, such as a direct injection fuel rail, directed to by the arrow in FIG. 2.

The fuel pump 200 further includes a one-way discharge valve 238 positioned downstream of the pump chamber 232 and an outlet positioned downstream of the one-way discharge valve 238. The one-way discharge valve 238 may be in fluidic communication with a downstream direct injection fuel rail and fuel injectors via high-pressure fuel line 43, an example configuration of which is shown in FIG. 1. The one-way discharge valve 238 may be configured to permit fluid to flow through the valve in a downstream (forward) direction when the pressure of fuel in the pump chamber 232 exceeds a threshold valve and inhibit fuel flow in the downstream direction when the pump chamber pressure does not exceed the threshold value. On the other hand, the one-way discharge valve 238 is configured to inhibit or substantially prevent upstream fuel flow back into chamber 232 at all times. As shown, the one-way discharge valve is a check valve including a ball 240 coupled to a spring 242. However, other suitable one way valves may be utilized in other examples. It is noted that check valves 207 and 208 share the ball-spring configuration of one-way discharge valve 238.

It is noted that pressure device 204 may be a separate component attached to DIV 216 and HP pump 200 via fuel inlet line 235, as is depicted in FIG. 2. In this way, pressure device 204 may be an add-on feature that is easily attached to an existing HP pump 200 and DIV 216. Alternatively, pressure device 204 may be affixed to and integrally formed with the HP pump 200 such that the device housing of device 204, including the inlet and outlet chambers and other components, may be contiguous with or the same as the housing of the HP pump. The cost associated with integrating the pressure device inside the HP pump may be lower than the add-on configuration of the pressure device. Other configurations may be possible while remaining within the scope of the present disclosure.

With the general physical layout of pump 200, DIV 216, and pressure device 204 presented, attention is now turned toward a method for operating these components to provide pressurized fuel or other fluid to the direct injection fuel rail. FIGS. 2-4 depict several configurations of pump 200, DIV 216, and pressure device 204. In particular, the figures depict several intake and delivery strokes of the pump 200 along with opening/closing of DIV 216 and passive operation of pressure device 204. As mentioned previously, passive control of pressure device 204 may involve no commands from the controller, thereby enabling pressure device 204 to be a pure mechanical device. As such, electronic malfunction of pressure device 204 may be reduced (i.e., eliminated).

FIG. 2 shows the HP fuel pump 200 in an intake stroke where the DIV 216 is deactivated to the open position, allowing fuel to flow past sealing element 224 and sealing surface 226. It will be appreciated that deactivation may include an operating condition where a controller is not sending control signals to the DIV 216 and the sealing element in the DIV remains substantially stationary. Therefore, when the DIV 216 is deactivated in the open position, fuel may flow upstream and downstream through the valve. As described previously, the closing and opening actions of the DIV 216 may contribute to ticking noise of the HP pump 200. Therefore, it will be appreciated that deactivating the DIV reduces noise, vibration, and harshness generated in the fuel pump 200. Furthermore, keeping the DIV 216 deactivated without commanding activation may further reduce ticking noise generated by the HP pump 200. As a result, the longevity of the pump and surrounding components may be increased and vehicle operator satisfaction and comfort may also be increased.

FIG. 2 shows the fuel pump 200 during the intake stroke when the volume of the pump chamber 232 is increasing and fuel is flowing through the DIV 216 and pressure device 204 into the pump chamber 232, indicated via arrows 250. The plunger 236 is moving in a downward direction indicated via arrow 260 to increase the volume of the pump chamber 232. Specifically, in FIG. 2, fuel is shown flowing through inlet 202 into inlet chamber 205 of pressure device 204. As previously stated, check valve 207 may act as a one-way valve enabling fuel to flow in a downstream direction but inhibiting fuel to flow in an upstream direction into inlet chamber 205. Fuel may flow from the check valve 207 of the pressure device 204 to the DIV 216. As shown, the DIV 216 is in an open configuration and the valve is deactivated. Therefore, fuel may flow through the DIV 216 into the pump chamber 232 as indicted by the fuel direction arrows 250 in FIG. 2. During the intake stroke, pressure relief valve 208 may remain in the shown closed position. The intake stroke of pump 200 depicted in FIG. 2 may be a common intake stroke, regardless of the operating speed of the engine.

FIG. 3 shows the fuel pump 200 during a delivery stroke during an engine idling condition, where the engine speed is below a speed threshold, thereby indicating a low amount of masking noise produced by the engine. The delivery stroke during the engine idling condition may be referred to as a first delivery stroke of the HP pump 200. During the first delivery stroke, plunger 236 is moving in a direction indicated via arrow 300 to decrease the volume of the pump chamber 232. As the plunger 236 moves to decrease volume of pump chamber 232, fuel contained in chamber 232 may be compressed and pressurized.

In FIG. 3, the DIV 216 remains deactivated in an open position. However, inlet check valve 207 of the pressure device 204 may be positioned to substantially inhibit fuel flow from outlet chamber 206 to inlet chamber 205. Furthermore, while fuel pressure of outlet chamber 206 is below the pressure setting of relief valve 208, the relief valve 208 may remain closed as shown in FIG. 3 such that fuel is inhibited from flowing to inlet chamber 205. As such, since DIV 216 is open to allow pressurized fuel from chamber 232 to enter outlet chamber 206 as shown by fuel direction arrows 303, fuel may compress accumulator 209 as shown by arrows 301. In this way, excess fuel pressure may be stored by accumulator 209 rather than ejecting backwards through relief valve 208 and flowing backwards (fuel backflow) towards the low-pressure pump via low-pressure line 41. It is understood that the motion of valves 207 and 208 along with the compression of accumulator 209 may be accomplished without electronic activation by a controller. Therefore, as fuel is compressed by plunger 236, as long as the fuel pressure remains below the setting of relief valve 208, fuel may be directed towards one-way discharge valve 238.

As shown in FIG. 3, fuel from compression chamber 232 flows through the one-way discharge valve 238, indicated via arrows 302. Fuel may then flow to downstream components such as through high-pressure fuel line 43 to the direct injection fuel rail and/or a fuel injectors. In this way, the pressure device 204 may be operated during the first delivery stroke during engine idling to enable fuel to be provided to components downstream of the pump. Furthermore, since the DIV 216 may remain in the deactivated (open) position, any ticking noise associated with the DIV 216 may be reduced (e.g., eliminated) during this pump operating method. During the first delivery stroke at engine idle, pressurized fuel may compress accumulator 209 to maintain a desired fuel pressure at idle without activating DIV 216 that may contribute to pump ticking noise. Furthermore, since accumulator 209 may store excess fuel pressure, relief valve 208 may remain closed so fuel does not expel towards the low-pressure pump.

FIG. 4 shows the fuel pump 200 during a delivery stroke during a non-idling engine condition, wherein the engine speed is above the speed threshold, thereby indicating a sufficient amount of masking noise produced by the engine to suppress the pump ticking noise. The delivery stroke during the non-idling engine condition may be referred to as a second delivery stroke of the HP pump 200. During the second delivery stroke, similar to the first delivery stroke, plunger 236 is moving in an upward direction indicated via arrow 400 to decrease the volume of the pump chamber 232.

As the plunger 236 moves to decrease the volume of pump chamber 232, fuel trapped in chamber 232 may be compressed and pressurized. However, different from what is shown in FIG. 3, upon a certain position of plunger 236 depending on the position of the driving cam, the controller may energize coil 222 of DIV 216 to close the valve. As such, DIV 216 may originally be in the open position such as that shown in FIG. 2. In other words, the opening and closing timing of DIV 216 may be based on angular position of the driving cam or engine crankshaft. In this way, the amount of compressed fuel in chamber 232 may vary depending on fuel system demand. This is the source of utility of the DIV 216 for many vehicle systems. In particular, the controller may energize the coil 222 to alter the position of the sealing element 224 when the DIV is activated. Thus, during activation (or deactivation) the DIV 216 receives control signals from a controller.

In FIG. 4, DIV 216 may be commanded to a closed position by energizing or activating coil 222. The command may be sent by a controller such as controller 100 of FIG. 1. Prior to closing of DIV 216, fuel may flow to outlet chamber 206 during a first portion of the upward stroke of plunger 236, indicated by arrow 400. As such, accumulator 209 may be compressed by pressurized fuel in the direction of arrow 401 shown in FIG. 4. Once DIV 216 is commanded to close, sealing element 224 may come into contact with sealing surface 226, thereby sealing the DIV 216 to inhibit fuel from traveling between chamber 232 and fuel line 235. When DIV 216 is closed, fuel in outlet chamber 206 and line 235 may remain until DIV 216 is re-opened during a subsequent pumping cycle of HP fuel pump 200. The closed position of DIV 216 is shown in FIG. 4. Furthermore, upon closing of DIV 216, fuel may continue to be compressed by plunger 236 in chamber 232. In response to the compression of the fuel, one-way discharge valve 238 may open as shown in FIG. 4 to allow pressurized fuel to exit chamber 232 in the direction shown by arrows 402. Pressurized fuel may then travel through high-pressure fuel line 43 to the direct injection fuel rail and related injectors as shown in FIG. 1.

A subsequent intake stroke such as the stroke shown in FIG. 2 may be repeated upon completion of the delivery stroke of plunger 236. If the engine speed is still above the threshold speed upon completion of the subsequent intake stroke, then following delivery strokes may be performed according to FIG. 4, wherein the DIV 216 is operated normally during the process of the second delivery stroke. Normal operation of DIV 216 may include energizing and de-energizing coil 222 depending on commands from the controller based on one or more vehicle parameters. In other words, when engine speed is high and engine noise is also high, the DIV 216 may be operated normally to produce ticking noise that may be masked by the elevated engine noise. Alternatively, if the engine speed is below the threshold speed upon completion of the subsequent intake stroke, then following delivery strokes may be performed according to the first delivery stroke of FIG. 3, wherein the DIV 216 remains in the open, de-energized position. In this way, ticking noise of HP pump 200 may be reduced when low engine noise is produced during low engine speeds.

In summary, the first and second delivery strokes may provide two different ways to regulate fuel pressure in the high-pressure fuel pump 200. Specifically, during an engine idling condition, HP pump pressure (fuel pressure) may be regulated via pressure device 204 which includes a first check valve 207 and a second check valve 208 with opposite orientations without activating DIV 216 coupled to an inlet of the high-pressure fuel pump. Alternatively, during a non-idling engine condition, activation of the DIV 216 may be adjusted to regulate fuel pressure in the HP pump 200. In other words, activation of the DIG 216 may be adjusted responsive to fuel pressure in HP pump 200 and/or fuel pressure in high-pressure line 43 and fuel rail 40. As seen in FIGS. 3 and 4, the second delivery stroke may be different than the first delivery stroke.

FIG. 5 shows a method 500 for pressurizing fuel for a direct injection fuel system via a HP fuel pump in an engine. The method 500 may be implemented via the vehicle, engine, fuel delivery system, and other similar features described above with regard to FIGS. 1-4 and subsequent figures or may be implemented via other suitable vehicles, engines, and/or fuel delivery systems. Additionally, for the sake of proper understanding, reference to components and features of FIGS. 2-4 will be provided in the below description of method 500. A part or all of method 500 may be executed by a controller with computer-readable instructions stored in non-transitory memory, such as controller 100 of FIG. 1, and the controller may be located on-board a vehicle with an engine system, such as engine system 10. It is noted that several steps of FIG. 5 may result as a consequence of the controller commanding DIV 216 to operate in a certain way, as explained below.

First, at 501, the method includes determining engine operating conditions. The engine operating conditions may include estimating (measuring) engine speed and determining the threshold speed with which to define engine idling and non-idling. The engine speed may be measured via one or more sensors located throughout the vehicle. Next, at 502, the method includes deactivating the DIV 216 to the open position or maintaining the DIV 216 in the open position if the valve 216 was originally in the open position. As previously mentioned, the neutral position or default position of DIV 216 may be the open position where springs 230 and 231 bias DIV 216 to the open position. As such, when no command (i.e., electric current) is provided to DIV 216 by the controller, then the default (open) position may be maintained. Alternatively, when a current is provided to DIV 216 to energize coil 222, DIV 216 may be activated to the closed position. Deactivation of DIV 216 may allow fuel to travel from the low-pressure pump through pressure device 204 into compression chamber 232 of the HP pump 200. At 503 the pump plunger 236 may travel to draw fuel into pump chamber 232. Steps 502 and 503 may be collectively referred to as the intake stroke of HP pump 200, as shown in FIG. 5. Next, at 504, the method includes determining if engine speed is less than the threshold speed. If the engine speed is below the threshold speed, then method 500 continues at 505 with a first delivery stroke during an idling condition. Alternatively, if the engine speed is above the threshold speed, then method 500 continues at 509 with a second delivery stroke during the non-idling condition. In one example, the first delivery stroke may be visually depicted in FIG. 3 while the second delivery stroke may be visually depicted in FIG. 4.

The first delivery stroke may commence at 505, wherein the method includes maintaining the DIV 216 in the open position, as shown in FIG. 3. As seen in FIG. 5, the first delivery stroke may include steps 505-508. Maintaining the open position may include sending no current to coil 222 of DIV 216. Therefore, maintaining the open position may require no additional computing power of the controller. Next, at 506, pump plunger 236 may pressurize the fuel by moving in the direction indicated by arrow 300 of FIG. 3. At 507 fuel may travel to pressure device 204 and compress accumulator 209. Particularly, fuel may remain in outlet chamber 206 as long as the fuel pressure does not exceed the pressure setting of pressure relief valve 208. Finally, at 508, upon fuel inside chamber 232 reaching a threshold pressure of the one-way discharge valve 238, the valve 238 may open to allow fuel to flow into high-pressure line 43 and downstream to the fuel rail and/or direct injectors. In this way, the first delivery stroke during engine idling may provide pressurized fuel to the engine and its cylinders while reducing (i.e., eliminating) operation of DIV 216 to reduce ticking noise.

Alternatively, the second delivery stroke may commence at 509, wherein the method includes activating the DIV 216 to the closed position, as shown in FIG. 4. As seen in FIG. 5, the second delivery stroke may include steps 509-512. Activating DIV 216 to the closed position may include sending an electrical current to coil 222 of DIV 216 to bring sealing element 224 into sealing contact with sealing surface 226. Therefore, activating the closed position may require a continuous flow of current from the controller. Next, at 510, plump plunger 236 may pressurize the fuel by moving in the direction indicated by arrow 400 of FIG. 4. At 511 fuel may remain in pump chamber 232 until the pressure setting (pressure threshold) of one-way discharge valve 238 is reached by the fuel pressure. Once the pressure setting has been reached, then at 512 the one-way discharge valve 238 may open to allow fuel to flow into high-pressure line 43 and downstream to the fuel rail and/or direct injectors. In this way, the second delivery stroke during engine non-idling (engine off-idling) may provide pressurized fuel to the engine and its cylinders while masking pump ticking noise by the engine noise. It is noted that plunger 236 may also pressurize fuel prior to activating the DIV 216 at step 509. As previously mentioned, it may be desirable to close DIV 216 based on angular position of the driving cam that drives plunger 236. As such, the DIV 216 may be closed partway through the second delivery stroke of plunger 236, thereby allowing a portion of fuel to escape into outlet chamber 206 and the remaining fuel to be compressed in chamber 232.

It is noted that some steps of method 500 may be directly commanded or completed by the controller while other steps may occur as a result of previous steps. In particular, steps 501, 502, 504, 505, and 509 may be commanded by the controller while the remaining steps occur based on the mechanical setup of the HP pump 200 and related components. Once the controller commands DIV 216 to activate or deactivate, then fuel is pressurized and travels according to the DIV 216 movement along with movement of plunger 236, which may be driven from the crankshaft of the engine, which may be at least partially controlled by the controller. In this way, the HP pump 200 and related components of FIGS. 2-4 may be mechanically controlled with limited intervention by the controller, thereby freeing a portion of computing power of the controller that may be otherwise dedicated to HP pump 200.

FIG. 6A shows a second example of a high-pressure fuel pump, pump 600, which shares many features of HP pump 200 of FIG. 3. Many devices and/or components in the system of FIG. 6A are the same as devices and/or components shown in FIG. 3. Therefore, for the sake of brevity, devices and components of the system of FIG. 6A, and that are included in the system of FIG. 3, are labeled the same and the description of these devices and components is omitted in the description of FIG. 6A. In particular, HP fuel pump 600 lacks an accumulator located in pressure device 204, such as accumulator 209 of FIG. 3. Furthermore, HP pump 600 may be operated according to method 600 with several modifications. One modification includes when fuel travels to pressure device 204 in step 507, wherein fuel fills outlet chamber 206 without compressing an accumulator since no accumulator is present in HP pump 600. However, the intake stroke, first delivery stroke, and second delivery stroke of HP pump 600 as described in method 500 operates substantially the same way as the corresponding strokes of HP pump 200 shown in FIGS. 2-4.

In particular, FIG. 6A displays a configuration of pump 600 similar to the configuration of pump 200 in FIG. 3, wherein the first delivery stroke is being performed. During the first delivery stroke while the engine is idling, DIV 216 may be maintained in the deactivated, open position to allow fuel to travel upstream as directed by arrows 603. Furthermore, fuel may be compressed by plunger 236 traveling in the direction shown by arrow 605. In this configuration, pressure device 204 may allow HP pump 600 to maintain a pressure to meet a fuel pressure requirement during the idling condition. In other words, while the engine is running below the threshold speed, a certain fuel pressure provided to the direct injectors may be desired to ensure efficient engine operation. As such, fuel may be compressed in chamber 232 and outlet chamber 206 to allow fuel to meet the pressure threshold of one-way discharge valve 238 and flow through valve 238 to line 43 as indicated by arrows 602. However, rather than allowing excess fuel pressure to act against accumulator 209 such as with pump 200, excess fuel pressure may be relieved via relief valve 208 shown by arrows 650. In other words, fuel pressure above the pressure threshold (setting) of valve 208 may be discharged into inlet chamber 205 and back into line 41 towards the low-pressure fuel pump. Allowing fuel to flow upstream (or backwards) toward the low-pressure pump may be referred to as fuel reflux. Furthermore, one-way discharge valve 238 may be closed during at least part of the first delivery stroke when fuel pressure has not yet reached the setting of valve 238. In this way, a desired fuel pressure range may be maintained by discharge valve 238 and relief valve 208.

Fuel reflux shown in FIG. 6A may also occur during the second delivery stroke when the engine is off-idle as determined by the controller. As described with regard to the second delivery stroke of FIG. 5, the DIV 216 may be closed during a later portion of the plunger stroke shown by arrows 605 in FIG. 6 and not prior to it. As such, before DIV 216 closes, pressurized fuel may enter outlet chamber 206 and pass through relief valve 208 upon reaching the pressure setting of valve 208. In this way, by removing accumulator 209 from pump 200, modified pump 600 may allow fuel reflux to alleviate excess fuel pressure instead of storing the pressure in accumulator 209. In some engine systems, fuel reflux may be desirable. In other fuel systems, fuel reflux may be undesirable, in which case HP pump 200 of FIGS. 2-4 may be used to substantially eliminate fuel reflux by providing accumulator 209.

FIG. 6B shows a third example of a high-pressure fuel pump, pump 680, which shares many features of HP pump 600 of FIG. 6A. Many devices and/or components in the system of FIG. 6B are the same as devices and/or components shown in FIG. 6A. Therefore, for the sake of brevity, devices and components of the system of FIG. 6B, and that are included in the system of FIG. 6A, are labeled the same and the description of these devices and components is omitted in the description of FIG. 6B. As mentioned previously, pressure device 204 of FIG. 3 may be integrated into the housing of HP pump 200. In a similar fashion, the pressure device 204 of FIG. 6A (lacking the accumulator of previous examples) may be included inside HP pump 680 as shown in FIG. 6B. Referring to FIG. 6B, inlet check valve 207 and pressure relief valve 208 maintain the same orientations as shown in previous examples, that is, check valve 207 is biased to inhibit upstream or fuel backflow while relief valve 208 is biased to inhibit downstream or forward fuel flow. Pump compression chamber 232 may be elongated such that inlet chamber 205 may consume a portion of the interior of pump 680, where the wall containing valves 207 and 208 may separate inlet chamber 205 from compression chamber 232. Furthermore, in this configuration, outlet chamber 206 as seen in previous examples may consume the same volume as compression chamber 232 in FIG. 6B. In this example, pressure device 204 is part of and inside HP pump 680.

HP pump 680 may operate in substantially the same was as described in method 500 of FIG. 5 with a modification. At step 507, rather than compressing the accumulator since an accumulator is not included in the example of FIG. 6B, fuel may remain in chamber 232 as long as the fuel pressure is below the setting of relief valve 208. However, the intake stroke, first delivery stroke, and second delivery stroke of HP pump 680 as described in method 500 operates substantially the same way as the corresponding strokes of HP pump 200 shown in FIGS. 2-4. The main difference is that pressure device 204 is contained inside HP pump 680 adjacent to compression chamber 232. With this configuration as seen in FIG. 6B, fuel pressure acting on discharge valve 238 may further quiet HP pump 680 even when DIV 216 is energized. This advantage may set the configuration of FIG. 6B apart from other pumps presented herein.

FIG. 6B displays a configuration of pump 680 similar to the configuration of pump 600 in FIG. 6A, wherein the first delivery stroke is being performed with fuel reflux. During the first delivery stroke when the engine is idling, DIV 216 may be maintained in the deactivated (de-energized), open position to allow fuel to travel upstream as directed by arrows 603. When an excess fuel pressure builds inside compression chamber 232, relief valve 208 may open to allow fuel reflux back through low-pressure line 41 and towards the low-pressure fuel pump. In other words, relief valve 208 may open when pump chamber pressure is higher than a desired idling pressure. At the same time, one-way discharge valve 238 may be opened to allow fuel to travel downstream. Alternatively, discharge valve 238 may be closed if the pressure across valve 238 is not sufficient to compress spring 242. This situation may occur when direct injection to the engine has been reduced, thereby allowing the fuel pressure in high-pressure line 43 to remain elevated. In this way, a desired range of pressure provided by HP pump 680 may be maintained by expelling fuel upstream through relief valve 208.

FIG. 7 shows another example of a high-pressure fuel pump, pump 700, which shares many features of HP pump 200 of FIG. 2. Many devices and/or components in the system of FIG. 7 are the same as devices and/or components shown in FIG. 2. Therefore, for the sake of brevity, devices and components of the system of FIG. 7, and that are included in the system of FIG. 2, are labeled the same and the description of these devices and components is omitted in the description of FIG. 7. In particular, accumulator 209 is not present in the outlet chamber 206 of pressure device 204 of FIG. 7. Furthermore, inlet line 235 is absent in FIG. 7. As such, rather than being separate from the HP pump, pressure device 204 is integrally formed with the pump and DIV 216, thereby forming HP pump 700 that includes DIV 216 and pressure device 204. Furthermore, an inlet passage 754 is fluidically attached to the inlet chamber 205 of pressure device 214. The inlet passage 754 leads from HP pump 700 and connects to a damper 751. Damper 751 may be a pressure storage device such as an accumulator designed to allow fluid pressure to act against a force such as a spring (as shown in FIG. 7). The damper 751 may aid in reducing hydraulic pulsations that contribute to the noise and vibrations generated by the HP pump 700 and associated components. Specifically, the damper 751 may reduce low-frequency hydraulic pulsations.

FIG. 7 displays a configuration of HP pump 700 similar to the configuration of pump 200 in FIG. 2, wherein the intake stroke is being performed. During the intake stroke, DIV 216 may be deactivated (de-energized) to the open position to allow fuel to travel into chamber 232 as indicated by arrows 752. Furthermore, piston 236 may travel in a downward direction as indicated by arrow 705 while fuel from inlet chamber 205 flows into outlet chamber 206 via inlet check valve 207, shown by arrows 750. During the intake stroke, fuel may fill chamber 232 and have a pressure similar to the pressure of fuel provided by the low-pressure pump 34 and fuel in low-pressure line 41.

FIG. 8 shows HP pump 700 during either the aforementioned first or second delivery strokes with fuel reflux occurring. As described previously with regard to FIG. 6A, fuel reflux is not designed to occur with HP pump 200 of FIGS. 2-4 because of the presence of accumulator 209. However, since accumulator 209 is absent from HP pump 700, fuel reflux is allowed to occur. In particular, as seen in FIG. 8, while DIV 216 is in the deactivated, open position, fuel may travel in the 803 direction and out of the outlet chamber 206 via pressure relief valve 208, shown by arrows 850. Furthermore, at least a portion of the fuel pressure may act against damper 751 as it flows upstream and out of pressure device 204. At the same time, fuel may be flowing into high-pressure line 43 via fuel discharge valve 238. In some examples, depending on the pressure settings of the various check valves and relative fuel pressures upstream, inside, and downstream of HP pump 700, discharge valve 238 may closed. Also, piston 236 may be traveling in the upward direction as shown by arrow 801. If the second delivery stroke is being performed, wherein the engine is operating above the threshold speed, then the instant of HP pump 700 operation shown in FIG. 8 may occur prior to DIV 216 being activated to trap the desired amount of fuel in compression chamber 232. Once DIV 216 is energized, fuel inside chamber 232 may be forced downstream by piston 236 through discharge valve 238. With HP pump 700 of FIGS. 7 and 8, the housing of pressure device 204 is the same as the housing of DIV 216 and the rest of the pump 700.

FIG. 9 shows another example of a high-pressure fuel pump, pump 900. While HP pump 200 of FIGS. 2-4, pump 600 of FIG. 6A, pump 680 of FIG. 6B, and pump 700 of FIGS. 7 and 8 illustrate detailed schematics of the pumps and their related components, HP pump 900 is simplified to illustrate the basic components and structural relationships of the pump system. As seen in FIG. 9, pressure device 204 is fluidically coupled to a solenoid-activated inlet check valve 312 via a passage 335. The solenoid-activated inlet check valve 312 may be similar or identical to the digital inlet valve 216 of previous figures. Furthermore, controller 100 is included in FIG. 9 for controlling solenoid valve 312 as well as sensing an angular position of driving cam 310.

Referring to FIG. 9, inlet 303 of high-pressure fuel pump compression chamber 308 is supplied fuel via a low-pressure fuel pump as shown in FIG. 1. The fuel may be pressurized upon its passage through high-pressure fuel pump 900 and supplied to a fuel rail through pump outlet 304, such as direct injection fuel rail 40 of FIG. 1. In the depicted embodiment, HP pump 900 may be a mechanically-driven displacement pump that includes a pump piston 306 and piston rod 320, a pump compression chamber 308, and a step-room 318. A passage that connects step-room 318 to a pump inlet 399 may include an accumulator 309, wherein the passage allows fuel from the step-room to re-enter the low-pressure line surrounding inlet 399. Piston 306 also includes a top 305 and a bottom 307. The step-room and compression chamber may include cavities positioned on opposing sides of the pump piston. In one example, the engine controller may be configured to drive the piston 306 in direct injection pump 900 by driving cam 310 via a crankshaft of the engine. For example, cam 310 may include four lobes and complete one rotation for every two engine crankshaft rotations.

Piston 306 reciprocates up and down within compression chamber 308. HP pump 900 is in a compression stroke when piston 306 is traveling in a direction that reduces the volume of compression chamber 308. HP injection pump 900 is in a suction stroke when piston 306 is traveling in a direction that increases the volume of compression chamber 308.

A solenoid activated inlet check valve 312, or digital inlet valve (DIV), may be coupled to pump inlet 303. The controller may be configured to regulate fuel flow through inlet check valve 312 by energizing or de-energizing the solenoid valve (based on the solenoid valve configuration) in synchronism with the driving cam 310. Accordingly, solenoid activated inlet check valve 312 may be operated in two modes. In a first mode, solenoid activated check valve 312 is positioned within inlet 303 to limit (e.g. inhibit) the amount of fuel traveling upstream of the solenoid activated check valve 312. In comparison, in a second mode, solenoid activated check valve 312 is effectively disabled and fuel can travel upstream and downstream of inlet check valve.

As such, solenoid activated check valve 312 may be configured to regulate the mass (or volume) of fuel compressed into the high-pressure fuel pump. In one example, the controller may adjust a closing timing of the solenoid activated check valve to regulate the mass of fuel compressed. For example, a late inlet check valve closing may reduce the amount of fuel mass ingested into the compression chamber 308. The solenoid activated check valve opening and closing timings may be coordinated with respect to stroke timings of the high-pressure fuel pump. Used in coordination with pressure device 204, check valve 312 may be operated according to method 500 of FIG. 5. As previously described, deactivation of valve 312 may also reduce ticking noise produced by valve 312.

Pump inlet 399 allows fuel to pressure device 204 and through inlet check valve 207. Pressure device 204, as previously described, may be positioned upstream of solenoid-activated inlet check valve 312 via passage 335. Inlet check valve 207 is biased to substantially prevent fuel flow out of solenoid activated check valve 312 and into pump inlet 399. Check valve 207 allows flow from the low-pressure fuel pump to solenoid activated check valve 312. Check valve 207 may be coupled in parallel with pressure relief valve 208. Pressure relief valve 208 allows fuel flow out of solenoid activated check valve 312 toward the low-pressure fuel pump when pressure between pressure relief valve 208 and solenoid operated check valve 312 is greater than a predetermined pressure (e.g., 10 bar). When solenoid operated check valve 312 is deactivated (e.g., not electrically energized), solenoid operated check valve 312 operates in a pass-through mode and pressure relief valve 208 regulates pressure in compression chamber 308 to the single pressure relief setting of pressure relief valve 301 (e.g., 15 bar). Furthermore, accumulator 209 may store fuel pressure depending on the elastic strength qualities of accumulator 209. Regulating the pressure in compression chamber 308 allows a pressure differential to form from piston top 305 to piston bottom 307. The pressure in step-room 318 is at the pressure of the outlet of the low-pressure pump (e.g., 5 bar) while the pressure at piston top is at pressure relief valve regulation pressure (e.g., 15 bar). The pressure differential allows fuel to seep from piston top 305 to piston bottom 307 through the clearance between piston 306 and pump cylinder wall 350, thereby lubricating high-pressure fuel pump 900.

A forward flow outlet check valve 316 (or one-way discharge valve) may be coupled downstream of an outlet 304 of the compression chamber 308. Outlet check valve 316 opens to allow fuel to flow from the compression chamber outlet 304 into a direct injection fuel rail only when a pressure at the outlet of high-pressure fuel pump 900 (e.g., a compression chamber outlet pressure) is higher than the pressure setting of valve 316. Another check valve 314 (fuel rail pressure relief valve) may be placed in parallel with check valve 316. Valve 314 allows fuel flow out of the DI fuel rail toward pump outlet 304 when the direct injection fuel rail pressure is greater than a predetermined pressure. Valve 314 may act as a safety valve that does not interfere with normal pump operation.

In this way, by providing a high-pressure fuel pump with a pressure device as previously described, ticking noise produced by the pump and in particular the digital inlet valve may be reduced during engine idling operation. Instead of attempting to dampen the ticking noise by spending resources on NVH countermeasures, the inventors herein have provided the pressure device as an inexpensive solution for the ticking noise issue. Furthermore, the pressure device may be attached to the inlet of the digital inlet valve (and HP pump) as an add-on feature, thereby reducing the need to redesign existing HP pumps. As such, existing vehicles may be equipped with the pressure device without removing and/or altering major vehicle components. With the addition of the accumulator in the pressure device, fuel reflux into the low-pressure fuel line and backwards toward the low-pressure pump may be reduced (i.e. eliminated). Alternatively, if fuel reflux is desired, the accumulator may be removed from the pressure device to allow fuel reflux to occur. Among other benefits of the pressure device, the desired fuel pressure delivered to the high-pressure fuel line and fuel rail may be provided while the digital inlet valve is deactivated during engine idling. In this way, the addition of the pressure device may not adversely affect engine and fuel system performance.

The inventors herein have recognized that ticking noise generated by the high-pressure fuel pump may originate from other components besides the digital inlet valve. The example fuel pumps and related operation methods described in the previous figures may at least partially alleviate the ticking noise associated with opening and closing of the DIV when there is not a sufficient amount of engine noise to mask the ticking noise (during idling). Another source of the ticking noise may be hydraulic pulsations to the chassis fuel line or low-pressure fuel line. The pulsations may excite the vehicle body through various mounting clips and other components that hold the fuel system to the vehicle. As such, excessive vibration and noise may be transmitted throughout the vehicle from the fuel system.

Often sound-dampening solutions are provided, wherein dampers, isolated clips, and other components are added to the fuel system to aid in reducing the noise associated with hydraulic pulsations. However, money can be saved by modifying the high-pressure fuel pump and/or fuel system to reduce the volume of the noise rather than simply covering or masking the noise. As such, to at least partially alleviate the noise and vibration associated with the hydraulic pulsations, another modified high-pressure fuel pump with a DIV is provided with an attached flow control valve.

FIG. 10A shows another example high-pressure fuel pump, pump 980, with a flow control valve 807 in a pressure device 804 attached to pump 980 via inlet line 235. Many devices and/or components in the system of FIG. 10A are the same as devices and/or components shown in FIG. 6A. Therefore, for the sake of brevity, devices and components of the system of FIG. 10A, and that are included in the system of FIG. 6A, are labeled the same and the description of these devices and components is omitted in the description of FIG. 10A. Referring to FIG. 10A, the pressure device 804 is shown including flow control valve 807 along with an inlet chamber 805 and an outlet chamber 806 separated by wall 814. A pressure relief valve and an accumulator are not included in pressure device 804. Flow control valve 807 may include one or more weep channels 810 located around the periphery of the ball of sealing device of valve 807. As seen in the detail view of the wall of pressure device 804 surrounding valve 807, the weep channels 810 may include curved channels that surround a generally circular opening 812. The surrounding wall 814 may be contiguous with the rest of the wall that divides inlet chamber 805 from outlet chamber 806. In particular, wall 814 may be solid material while the shape of opening 812 and weep channels 810 may be defined by empty space or a lack of material. Opening 812 allows fuel to flow into and out of chamber 806 and to/from HP pump 980.

For general operation of HP pump 980 with pressure device 804, three different strokes may be commanded. An intake stroke may include moving plunger 236 in a downward direction, opposite to the direction of arrow 815 shown in FIG. 10A. During the intake stroke, fuel may enter pressure device 804 from low-pressure line 41 through inlet 202. Flow control valve 807 may allow fuel to enter outlet chamber 806 when the fuel overcomes a spring or other force to bias valve 807 towards a closed position. The spring force may be low enough such that fuel may flow substantially uninhibited from inlet chamber 805 to outlet chamber 806. Furthermore, DIV 216 may be deactivated to a default open position to allow fuel to enter compression chamber 232 via inlet line 235.

Next, during an idling (first) delivery stroke with fuel reflux, wherein the engine is in the idling state as previously described, plunger 236 may move in the upward direction indicated by arrow 815. As the plunger is moving, DIV 216 is maintained in the deactivated state to allow fuel to flow freely through DIV 216 as shown by arrows 813. During the idling delivery stroke, flow control valve 807 may be closed as shown in FIG. 10A, but the weep channels 810 allow a limited amount of fuel to flow backwards into inlet chamber 805 and into low-pressure line 41 as shown by arrows 860. The amount of fuel that flows through weep channels 810 may be smaller compared to the amount of fuel that flows through a full pressure relief valve, such as valve 208 of FIG. 3. As such, high-frequency hydraulic pulsations caused by fuel flowing upstream from the HP pump 980 may be reduced by fuel flowing through weep channels 810, thereby also reducing the associated noise and vibration (NVH effects). Furthermore, the limited amount of fuel escaping through weep channels 810 may not inhibit pressurizing of fuel in compression chamber 232. FIG. 10A depicts HP pump 980 and related components during the idling delivery stroke, and specifically when fuel reflux is occurring. Also, as explained below, FIG. 10A depicts the off-idling delivery stroke with fuel reflux prior to activation of the DIV 216 to trap a volume of fuel in chamber 232 for compression and delivery to fuel rail 40.

FIG. 10A shows one-way discharge valve 238 in the closed position, wherein fuel pressure within chamber 232 has not yet reached the pressure setting of valve 238. Upon reaching the pressure setting, valve 238 may open to allow fuel to enter high-pressure line 43. During this time and throughout the idling delivery stroke, fuel may continually flow upstream through the weep channels 810. In this way, high-frequency hydraulic pulsations and the associated noise may be reduced while maintaining the desired fuel pressure. In this case, the desired fuel pressure may be at or near the pressure setting of valve 238. In this way, fuel pressure is at least partially regulated via pressure device 804 and flow control valve 807.

Instead of performing the idling delivery stroke, a non-idling or off-idling (second) delivery stroke may be commanded that involves activating the DIV 216. As previously described, the non-idling condition of the engine may be defined as running above the threshold speed. During the non-idling delivery stroke, plunger 236 may move in the upward direction as shown by arrow 815 in FIG. 10A. Upon a certain position of plunger 236 as determined by the driving cam providing motion to plunger 236, DIV 216 may be commanded by controller to activate (energize), thereby closing the valve to substantially inhibit fuel from flowing through DIV 216. Once DIV 216 closes, fuel in outlet chamber 806 may continue flowing through weep channels 810 or stop upon a pressure balance between chambers 805 and 806. As plunger 236 continues its delivery stroke, fuel may be compressed in chamber 232 and sent to high-pressure line 43 via discharge valve 238. After DIV 216 closes, hydraulic pulsations may be reduced since fuel is trapped inside chamber 232 and not allowed to flow upstream through pressure device 804. Discharge valve 238 and DIV 216 regulate the pressure and volume of fuel compressed in chamber 232.

FIG. 10B shows another example high-pressure fuel pump, pump 990, which is similar to pump 980 of FIG. 10A. Many devices and/or components in the system of FIG. 10B are the same as devices and/or components shown in FIG. 10A. Therefore, for the sake of brevity, devices and components of the system of FIG. 10B, and that are included in the system of FIG. 10A, are labeled the same and the description of these devices and components is omitted in the description of FIG. 10B. The primary difference between pumps 990 and 980 is that HP pump 990 of FIG. 10B excludes inlet line 235 that connects pressure device 804 to DIV 216 in FIG. 10A. In FIG. 10B, pressure device 904 is integrally part of HP pump 990. In particular, pressure device 904, DIV 216, and other pump components such as chamber 232 and piston 236 are included in HP pump 990. As such, pressure device 804 may be an add-on feature in FIG. 10A while pressure device 904 is included as part of and contiguous with HP pump 990 in FIG. 10B.

In this way, a method is provided, comprising: during an idling delivery stroke of a high-pressure fuel pump, regulating fuel pressure via a pressure device including a flow control valve with weep channels for flowing fuel upstream of the pressure device while a digital inlet valve coupled to an inlet of the high-pressure fuel pump is deactivated; and during a non-idling delivery stroke of the high-pressure fuel pump, activating the digital inlet valve to regulate fuel pressure. A fuel system may be provided for performing the idling and non-idling delivery strokes of the HP pump. As such, a fuel system is provided, comprising: a high-pressure fuel pump with an outlet fluidly coupled to a fuel rail and an inlet fluidly coupled to a digitally-controlled inlet valve coupled to an electronic control system, the digital inlet valve receiving fuel from a low-pressure fuel pump; and a pressure device located upstream of the digital inlet valve, the pressure device including a flow control valve with weep channels for allowing fuel to flow through the flow control valve when the flow control valve is closed.

It is noted here that the high-pressure pumps presented in FIGS. 2-4 and 6A-10B are presented as illustrative examples of several possible configuration for a HP pump with a pressure device. Components shown in the previous figures may be removed and/or changed while additional components not presently shown may be added to the HP pumps while still maintaining the ability to deliver high-pressure fuel to a direct injection fuel rail when the engine is running above or below the threshold speed.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

determining, via a controller, an engine idling condition in response to an engine running below a threshold speed and a non-engine idling condition in response to the engine running above the threshold speed;

in response to the engine idling condition, regulating high-pressure fuel pump pressure via a pressure device including first and second check valves with opposite orientations without activating a digital inlet valve coupled to an inlet of a high-pressure fuel pump, the regulating including delivering fuel to a fuel rail while maintaining the digital inlet valve deactivated, where the digital inlet valve is maintained deactivated until the end of the engine idling condition; and in response to the non engine idling condition, adjusting activation of the digital inlet valve to regulate fuel pressure.

2. The method of claim 1, wherein a solenoid of the digital inlet valve is not energized during the engine idling condition.

3. The method of claim 1, wherein regulating fuel pressure during the engine idling condition includes allowing fuel to backflow through the digital inlet valve into the pressure device, the second check valve substantially preventing fuel from flowing backward upstream of the pressure device while fuel pressure is lower than a threshold pressure, and delivering fuel to the fuel rail.

4. The method of claim 1, wherein regulating fuel pressure during the non-engine idling condition includes trapping fuel in a compression chamber of the high-pressure fuel pump.

5. The method of claim 1, wherein the pressure device is located inside the high-pressure fuel pump and the first check valve is an inlet check valve biased to allow fuel to enter a compression chamber of the high-pressure fuel pump, wherein the pressure device is downstream of the digital inlet valve, and wherein maintaining the digital inlet valve deactivated includes maintaining the digital inlet valve open.

6. The method of claim 1, wherein the second check valve is a pressure relief valve biased to allow fuel to backflow from the high-pressure fuel pump towards a low-pressure fuel pump when fuel pressure in a compression chamber of the high-pressure fuel pump exceeds a pressure threshold.

7. The method of claim 1, wherein the digital inlet valve is an electronically-controlled inlet valve switchable between an activated, closed position to substantially prevent backward fuel flow through the digital inlet valve and a deactivated, open position to allow fuel flow through the digital inlet valve.

8. A method for operating a high-pressure fuel pump, comprising:

determining, via a controller, an idling condition including operating the high-pressure fuel pump when an engine driving the high-pressure fuel pump is running below a threshold speed;

during an intake stroke of the high-pressure pump, deactivating a digital inlet valve to an open position, allowing fuel to flow into a compression chamber of the high-pressure fuel pump;

during a first delivery stroke of the pump when in the idling condition, delivering fuel to a fuel rail while maintaining the digital inlet valve in the open position, where fuel compressed by the pump compresses a flexible accumulator located in a pressure device upstream of the digital inlet valve, the pressure device including two check valves with opposite orientations, and where the digital inlet valve is maintained open until the idling condition ends; and during a second delivery stroke of the pump when not in the idling condition, delivering fuel to the fuel rail by activating the digital inlet valve to a closed position to trap fuel inside the compression chamber of the pump, and not compressing the accumulator by fuel.

9. The method of claim 8, wherein maintaining the digital inlet valve in the open position includes maintaining a solenoid valve deactivated.

10. The method of claim 8, wherein the flexible accumulator includes a generally spherical diaphragm allowing pressurized fuel to compress the accumulator during the first delivery stroke of the pump, and wherein the accumulator is downstream of the check valves.

11. The method of claim 8, wherein during the second delivery stroke, the digital inlet valve is activated to the closed position from the open position of the intake stroke, and wherein the accumulator is upstream of the check valves.

12. The method of claim 8, wherein during the second delivery stroke, the digital inlet valve is activated to the closed position based on angular position of a driving cam providing linear motion to a plunger of the high-pressure fuel pump, and wherein the pressure device is downstream of the digital inlet valve.

13. A fuel system, comprising:

a high-pressure fuel pump with an outlet fluidly coupled to a fuel rail and an inlet fluidly coupled to a digitally-controlled inlet valve coupled to an electronic control system, the digital inlet valve receiving fuel from a low-pressure fuel pump;

a pressure device including one or more check valves with opposite orientations; and a controller with machine-readable instructions stored in non-transitory memory for:

determining an idle condition in response to an engine speed below a threshold and determining a non-idle condition in response to the engine speed above the threshold;

delivering fuel to the fuel rail while maintaining the digital inlet valve deactivated during the idle condition; and delivering fuel to the fuel rail by activating the digital inlet valve during the non-idle condition;

wherein the pressure device includes an accumulator downstream of the one or more check valves; and wherein the digital inlet valve is maintained deactivated until the idle condition ends.

14. The system of claim 13, wherein the pressure device is located upstream of the digital inlet valve and integrally affixes to a housing of the high-pressure fuel pump, forming a single contiguous housing that includes the high-pressure fuel pump and pressure device.

15. The system of claim 13, wherein the pressure device is located upstream of the digital inlet valve and attached to the digital inlet valve via an inlet line, the pressure device including a device housing separate from a housing of the high-pressure fuel pump.

16. The system of claim 13, wherein the pressure device is located inside a compression chamber of the high-pressure fuel pump, downstream of the digital inlet valve.

17. The system of claim 13, the pressure device further comprising a device housing with a dividing wall located interior of the device housing, the dividing wall forming an inlet chamber and an outlet chamber of the pressure device.

18. The system of claim 17, wherein two of the check valves are positioned in the dividing wall to allow fuel to travel upstream or downstream of the pressure device based on pressure of the fuel; and wherein delivering fuel includes a plurality of pump strokes of the high-pressure fuel pump.

19. The system of claim 13, wherein one of the check valves is a pressure relief valve to allow fuel compressed above a threshold pressure to escape from the high-pressure fuel pump and pressure device back into a passage coupled to the low-pressure fuel pump.

20. The system of claim 13, wherein one of the check valves is a flow control valve biased to allow fuel to enter the digital inlet valve, the flow control valve including weep channels to allow fuel to flow upstream through the flow control valve.

* * * * *